US005219386A

United States Patent [19]

Kletzmaier et al.

[11] Patent Number: 5,219,386

[45] Date of Patent: Jun. 15, 1993

[54] LOCKER UNIT COMPRISING A PLURALITY OF LOCKERS

[75] Inventors: Karl Kletzmaier, Ottensheim; Gunther Krippner, Linz a. d. Donau, both of Austria

[73] Assignee: KEBA Gesellschaft m.b.H. & Co., Linz, Austria

[21] Appl. No.: 573,012

[22] PCT Filed: May 5, 1989

[86] PCT No.: PCT/AT89/00045

§ 371 Date: Jan. 4, 1991

§ 102(e) Date: Jan. 4, 1991

[87] PCT Pub. No.: WO89/11016

PCT Pub. Date: Nov. 16, 1989

[30] Foreign Application Priority Data

May 6, 1988 [AT] Austria ..... 1185/88

[51] Int. Cl.[5] ..... E05B 47/00

[52] U.S. Cl. ..... 70/277; 70/278; 70/282; 70/455

[58] Field of Search ..... 70/277–279, 70/282–284, 256, 262–264, 151, 151 R, 423–428, 432, 434, 455; 109/6, 7, 21, 24.1, 31, 45

[56] References Cited

U.S. PATENT DOCUMENTS

| | | | |
|---|---|---|---|
| 3,656,327 | 4/1972 | Ford et al. | 70/278 X |
| 3,797,936 | 3/1974 | Dimitriadis | 70/277 X |
| 3,825,917 | 7/1974 | Lucky | 109/21 X |
| 3,828,340 | 8/1974 | Bauer et al. | 70/278 X |
| 3,831,408 | 8/1974 | Featherman | 70/278 X |
| 3,836,945 | 9/1974 | Kinoshita et al. | 70/277 X |
| 4,038,846 | 8/1977 | Klann | 70/278 X |
| 4,148,092 | 4/1979 | Martin | 70/278 X |
| 4,494,805 | 1/1985 | Washburn | 70/279 X |
| 4,523,528 | 6/1985 | Hastings et al. | 109/7 X |
| 4,534,194 | 8/1985 | Aydin | 70/278 |
| 4,563,886 | 1/1986 | Kletzmaier et al. | 70/277 X |
| 4,602,150 | 7/1986 | Nishikawa et al. | 70/455 X |
| 4,649,833 | 3/1987 | Cummins | 70/278 X |
| 4,656,852 | 4/1987 | Deschamps | 70/277 |
| 4,723,428 | 2/1988 | Yamaguchi | 70/455 |
| 4,755,799 | 7/1988 | Romano | 70/278 X |
| 4,763,937 | 8/1988 | Sittnick, Jr. et al. | 70/277 X |
| 4,784,415 | 11/1988 | Malaval | 70/282 X |
| 4,807,455 | 2/1989 | Mauer | 70/277 |

*Primary Examiner*—Peter M. Cuomo
*Assistant Examiner*—Suzanne L. Dino
*Attorney, Agent, or Firm*—Collard & Roe

[57] ABSTRACT

A locker unit comprises a plurality of lockers provided with doors equipped with a locking device. The locking device consists of a mechanical lock and an auxiliary lock having an electric drive for said device. The locking device comprises a rest position which blocks the access to the mechanical lock and/or its movement, and an opening position which frees said access and/or said movement.

30 Claims, 12 Drawing Sheets

Figure 1:
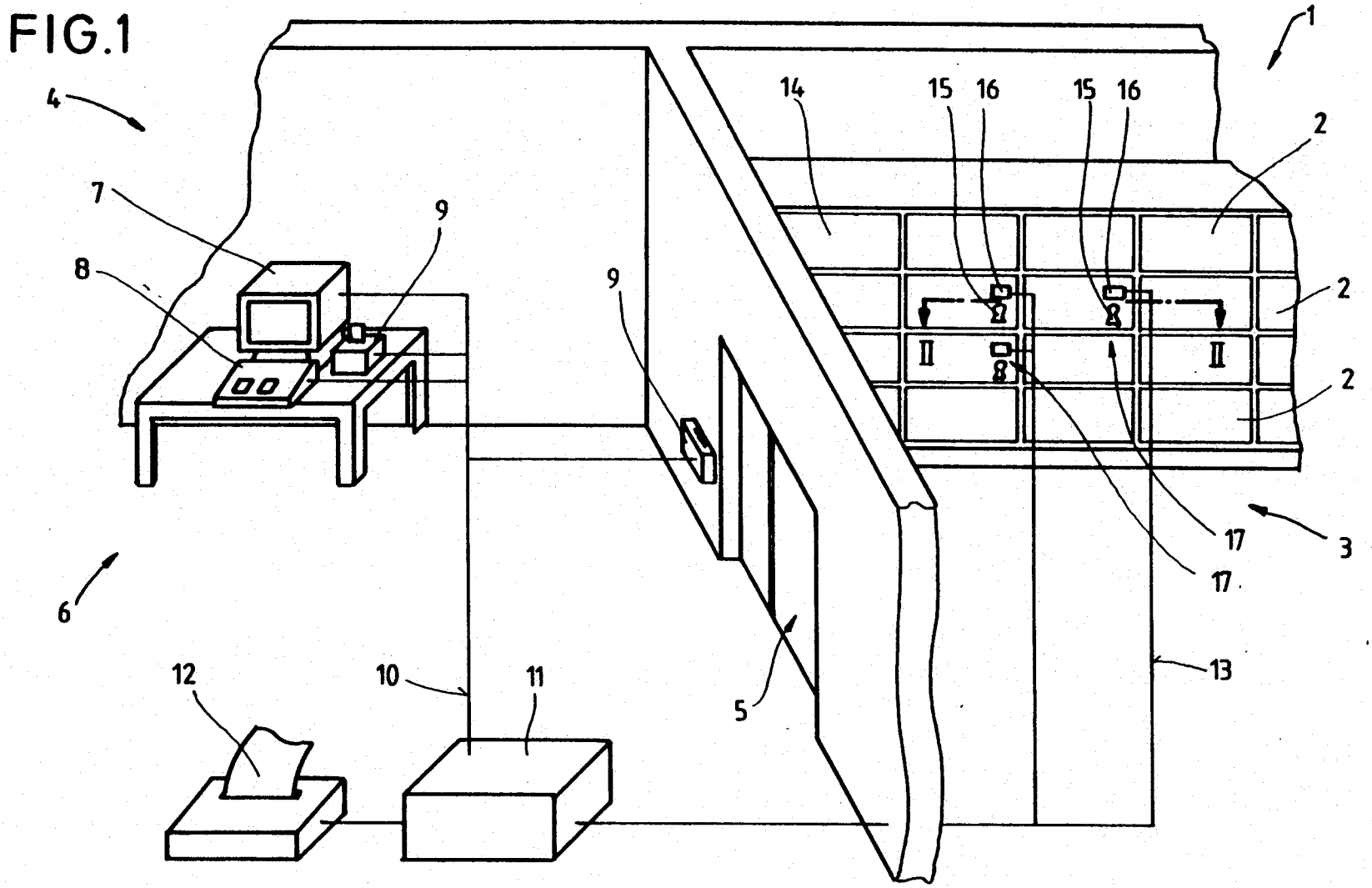

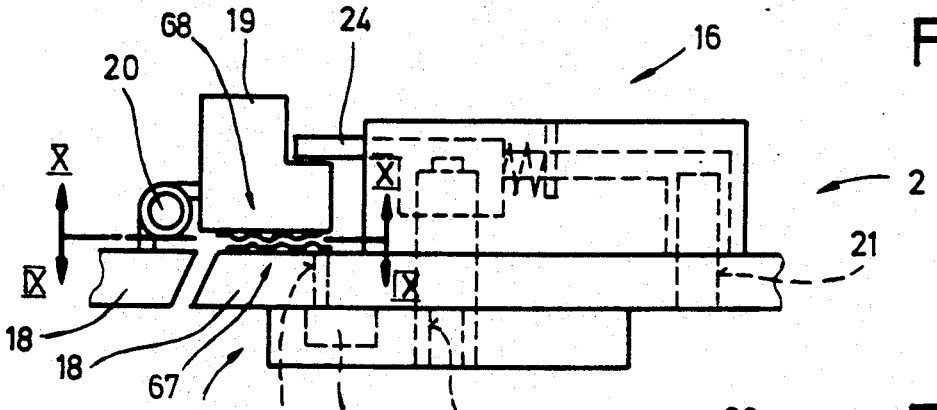
FIG. 8
FIG. 9
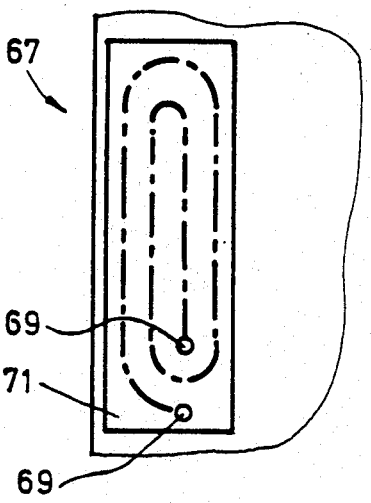
FIG. 10
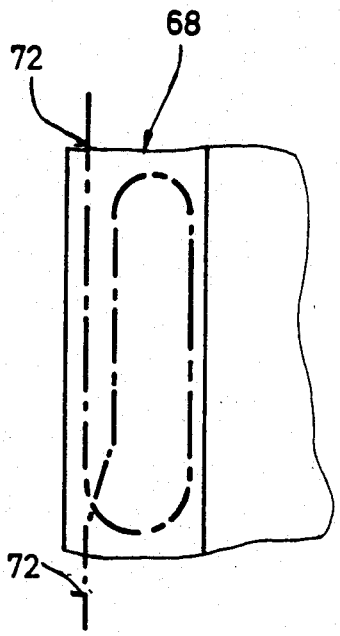
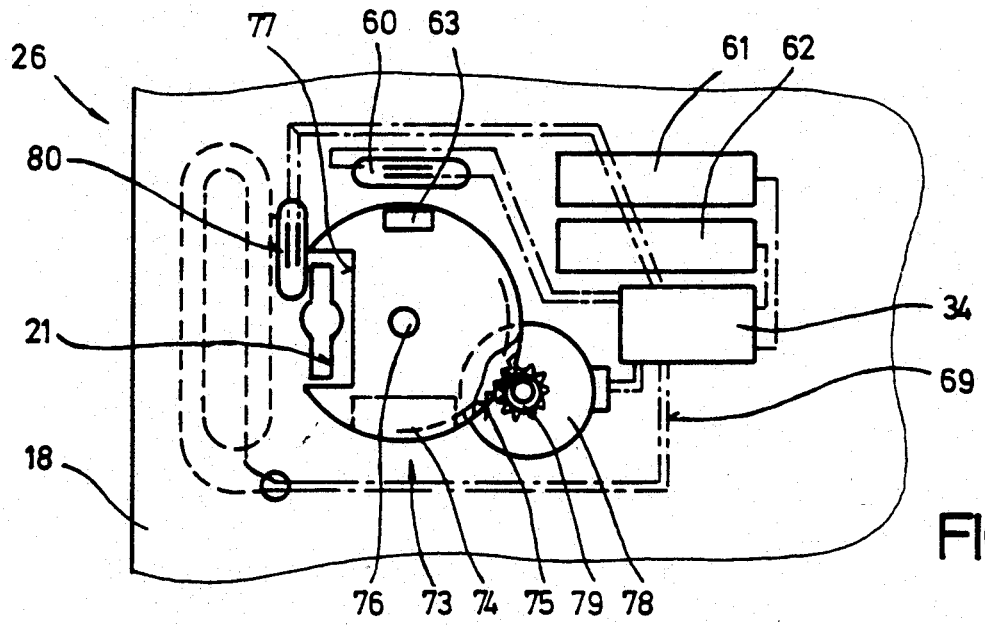
FIG. 11

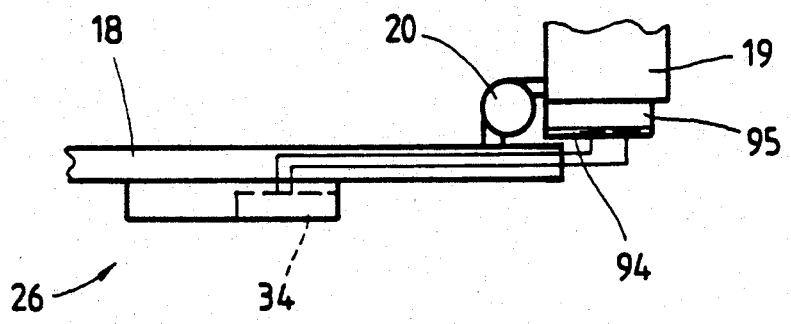
FIG. 14
FIG. 15
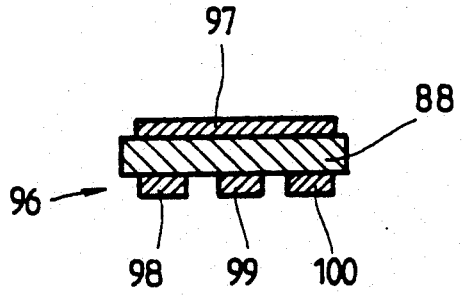
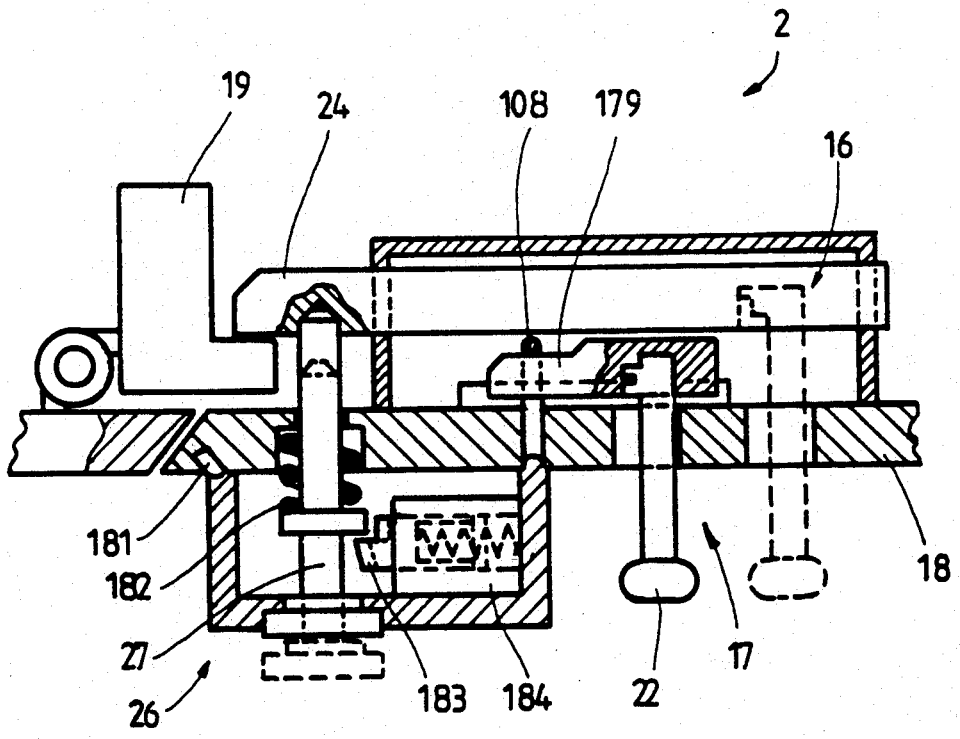
FIG. 32

LOCKER UNIT COMPRISING A PLURALITY OF LOCKERS

The invention relates to a locker unit comprising a plurality of lockers, each of which is provided with its own door, which has a locking device with a mechanical lock.

Various locker units are already known, comprising a plurality of lockers, in which each individual locker is provided with its own door and which can be locked with a locking device. Such lockers, also known as safety deposit boxes, are often used in banks, in order to allow customers to store valuables without any inspection by the bank. In order to achieve security to prevent unauthorized opening of a locker, these doors are usually equipped with two mechanical locks, one so-called customer lock and one bank lock. This ensures that after the customer has presented proof of authorization to open the locker, he can open it, and that in addition to the customer key, there is additional protection against unauthorized access. The so-called bank lock is opened by a bank employee who accompanies the customer after an identity check, and the customer can then open the locker with his own key. It is disturbing for many customers that the bank employee, who is present with the customer in the locker area, can observe the transactions of the customer. Accordingly, the banks have attempted to automate access to such locker units, with another factor being high personnel costs.

Therefore, locker units have become known in which one of the two locks in the door, specifically the bank lock, can be released via remote control, by a bank employee who works outside the locker unit. Such a lock is known, for example, from EP-OS 0 096 400. With additional security circuits, it is guaranteed that in case of a mistaken release by the bank employee, the bank lock falls into place again automatically, within a very short period of time, so that even a subsequent attempt by a customer to penetrate into a locker with a skeleton key will fail. In addition, numerous safety measures, such as movement sensors, infrared sensors, etc., are arranged as security devices in the locker unit, as is also usual in other vault units. It is disadvantageous in such locker units that either the personnel expenditure for operating the bank lock is relatively high, or that when using currently known locks, the energy for activating the electrically activated locks is relatively high. This requires extensive electrical installations, so that these systems are not suitable for upgrading doors of a locker unit which are equipped with two mechanical locks. In such units, all the doors of the locker unit would have to be replaced and special wiring would have to be installed. The expenditure for this is relatively high, and in addition, it is a significant problem that it is not always possible to bring all the customers together on the same day, to remove the valuables stored in the lockers, so that the renovation can be carried out.

The present invention is therefore based on the task of creating a locker unit of the type stated initially, in which locker units with mechanically activated doors, especially existing ones, can be equipped in simple manner in such a way that the so-called bank lock can be activated by remote control, without a high energy expenditure being required for this. Furthermore, it should be possible to refit existing locker units without having to replace the doors, and without having to install a costly wiring network.

This task of the invention is accomplished in that the locking device comprises an auxiliary lock assigned to the lock, which has an electrical drive for a locking device, and that the locking device comprises a rest position which blocks access to or movement of the mechanically activated customer lock, and an open position which frees this access and/or movement. This now makes it possible to achieve, in advantageous manner, that access to the mechanically activated customer lock, i.e. its activation, is prevented via the auxiliary lock. With this measure, which appears relatively simple, it is achieved that the energy expenditure for activation of the closing device of the auxiliary lock can be kept very low, since the lock does not have to perform a "blocking function." In addition, it is made possible, in surprisingly simple manner, for any locker unit with any lock system to be simply equipped with the new auxiliary lock.

According to a further embodiment, it is provided that the auxiliary locks of the individual lockers are connected with a control device and/or a central control unit, which allows central monitoring and activation of the lockers and therefore increased security against unauthorized opening of such lockers.

It is also possible, however, for the auxiliary lock to be arranged on an outside of the door facing away from the interior of the locker, and to be connected with the door via attachment means, which makes it possible to install the auxiliary lock on doors with mechanical locks, without an additional structure on the inside and thereby without reducing the interior space of the lockers.

Furthermore, it is also possible that the auxiliary lock is attached to the door of the locker in front of a keyhole of the mechanical lock. In this way, the auxiliary lock can be installed on a door, in simple manner, even if the door was originally provided with two mechanical locks, and additional security is provided by the remote control setting in the auxiliary lock.

It is also advantageous, however, if the attachment means are formed by a self-adhesive glue layer arranged on the auxiliary lock, since then no mechanical work of any kind is necessary on the door of the locker.

Furthermore, it is also possible, however, that the attachment means are formed by a holder element which acts together with the mechanical lock in the door, since then the second mechanical lock can be used to attach the auxiliary lock according to the invention.

However, it is also advantageous if the locking device has a rotating bolt, which comprises an activation button which projects out of the auxiliary lock and locking projections which penetrate an opening in a locking plate, these projections being arranged on the rotating bolt, and that the locking projections have an open position which aligns with the opening, and a closed position in which they are turned relative to the opening, and that the rotating bolt has a stop device assigned to it, with a spring device, which exerts a spring tension in the direction of the closed position of the rotating bolt, and which is assigned to a locking element which acts together with a bolt and a drive, since additional mechanical security can be achieved with minimal expenditure, and this mechanism can be simply changed from the locked to the unlocked position, with a drive which requires only little energy.

Furthermore, it is also possible, however, that the locking device has a locking pin arranged perpendicular to the door, which is adjustable, which has spring tension put on it against the direction of the locking bolt of the mechanical lock, via a spring device, to bring it into a rest position in which it engages with the locking bolt, and is held in this position via a locking element, to which an electrical drive which is mounted to be adjustable vertical to the locking pin is assigned. In this way, it is possible for the user of the locker, in simple manner, to engage the second security, namely the bank security, by himself, after having completed his manipulation, by pressing in the locking bolt like a push button.

Furthermore, it is also possible, however, that the locking device has an adjustable locking pin arranged perpendicular to the door, which is held in a rest position in which it engages with the locking bolt, by spring tension against the direction of the locking bolt of the mechanical lock, via a spring device, and can be adjusted by means of a drive, against the effect of the spring device, which limits the energy requirement for unlocking this additional mechanical lock to retraction of a locking pin, and therefore cannot be controlled by remote control, so that manual activation can be replaced in simple manner.

According to another embodiment, it is provided that an opening of the locking device which penetrates the auxiliary lock perpendicular to a door surface is arranged to be aligned to cover the keyhole of the mechanical lock, since this means that the key previously used for the mechanical customer lock can continue to be used.

Beyond this, however, it is also possible that the auxiliary lock has at least one shutter connected with the drive, which is adjustable relative to the keyhole. This embodiment particularly distinguishes itself by the fact that only the energy required for moving the shutter has to be applied, with this shutter representing the additional bank lock, with a corresponding structure, for example with a central lock or with a slit lock corresponding to the structure of a camera, only in a suitable robust form.

It is also advantageous if a drive is assigned to several auxiliary locks of several doors, which is arranged in an activation device adjustable relative to these, since this makes the expenditure for additional securing of the doors of the lockers slight, especially when refitting locker units which have doors with two locks.

Furthermore, it is also possible that the drive is connected to move with a key for the auxiliary lock, which especially has a rest position lying within the activation device and a locking position lying outside of the same, which allows simple mechanization of the activity previously performed by a bank employee.

Furthermore, it is also possible, however, that measurement value transmitters connected with the control device are assigned to the attachment means and/or the shutter and/or the auxiliary lock and/or the activation device. The measurement value sensors allow a determination of the lock status at any particular time, and can simultaneously be used to increase security against unauthorized opening of the lockers, which makes it possible not only to allow easier and more cost-effective operation of the locker unit, but also to increase the security standard of such a locker unit.

It is advantageous for this if a measurement value sensor is assigned to the locking device, especially the shutter, in the rest position, which is activated when the shutter is moved out of the rest position, since in this way, the position of the shutter can be monitored, both to monitor whether or not opening of the bank lock has taken place in authorized manner, and to monitor proper functioning of the bank lock after intentional opening by a bank employee has taken place.

Furthermore, it is also possible, however, that the measurement value sensor assigned to the auxiliary lock is activated at a distance from the door of the locker. With this arrangement of a measurement value sensor, it is possible, in simple manner, to monitor the position of the auxiliary lock relative to the door, so that even without complicated mechanical attachment devices, sufficient security against unauthorized removal of the auxiliary lock forming the bank lock can be achieved.

According to another embodiment, it is provided that the control device, i.e. the locker computer is connected, via translation components, e.g. modulator or demodulator, with a communications system for energy and/or signal transmission between the locker computer or the control device and the energy source and/or a central control unit. In this way, the expenditure for the energy supply and data transmission in such a locker unit can be reduced.

In this, it is advantageous if the communications system is formed by a line insulated from the armored wall and connected with the control devices, and by the armored wall of the locker unit, since in this way, the necessary energy and the control signals for a large number of lockers can be transmitted on a single wire, i.e. a single line.

According to another embodiment, it is provided that the line is formed by a track arranged on the doors of the lockers, with an insulating layer arranged in between, which makes it possible to eliminate laying additional lines in existing locker units.

For this, it is possible that the track consists of an electrically conductive, especially semi-conductive, plastic, which allows the line to be applied to be produced in the form of a design or a paint coating, so that its actual function is not immediately evident to an outsider.

Furthermore, however, it is also possible that the connection of the track between the doors and/or the corpus takes place by means of contact devices, which facilitates connection of several auxiliary locks of a locker unit.

According to another variation, it is provided that the line is formed by a photoconductor and that transmission elements for wireless connection of photoconductors are arranged between the doors and/or the armored wall, which makes it possible to have a seamless connection between the connecting photoconductor parts, even when a door with an auxiliary lock is opened. Furthermore, the cross-section required for such optical cables is slight and highly efficient, so that both greater energy as well as a large amount of data can be transmitted simultaneously.

It is advantageous for this if the transmission elements are provided with a swivelling lens, since this allows transmission in the hinge area of the door between the door and the corpus.

According to another embodiment, it is provided that two tracks are provided and that a track arranged on the door is switched with the one track when the door is closed and with the other track when the door is open, which ensures a perfect connection with the energy and data supply system both when the door is open and when it is closed.

Furthermore, it is also possible, however, that the contact device is formed by contacts arranged on the door and an armored wall forming the corpus, or between the doors, which align with one another, which makes it possible to indicate the status of the door, whether open or closed, immediately, via the interruption in the communications connection, since energy and data supply is only necessary in the closed condition of the door, in any case, so that in case of an interruption, the door can only have been opened with or without permission. However, on the basis of the release by the bank employee, it can be determined whether opening took place properly or improperly.

Furthermore, an embodiment is advantageous, in which the communications system between the auxiliary locks and the energy source and/or the central control unit is wireless, since this makes it possible to eliminate the production of tracks in the area of the corpus, i.e. the lockers, entirely, and if a suitable energy storage unit is used in the auxiliary lock, even short-term interruptions in the energy and data transmission by a customer cannot disturb the overall function of the auxiliary lock.

According to another embodiment, it is provided that the contact device is formed by inductive or capacitive transmission devices arranged on the door and on the corpus or its armored wall, since this allows simple, contact-free transmission of the energy and data.

According to another development, it is provided that the communications system has a receiver connected with a control device and a transmitter for carrier radiation and/or oscillation and/or force fields, such as heat, light, sound, magnetism, etc., connected with the energy source and/or the central control unit, and located at a distance from the receiver, which makes it possible for the supply to come from a central location, but not to be disturbed when individual doors in the locker unit are opened.

It is advantageous in this if the communications system between the energy source and the auxiliary lock comprises a light transmitter and a light receiver, especially for infrared light, since in this way, the light source which exists in such units in any case can be used for energy and data transmission, and this is a relatively unobtrusive supply unit, not immediately evident to the customer, which also requires little expenditure for refitting of such locker units.

It is advantageous in this if the translation component of the communications system has translation elements for superimposition of data on the carrier radiation, and for screening of information from the carrier radiation, between the central control unit and the auxiliary lock, since this makes it possible to use different frequencies in the light spectrum for data transmission and energy transmission, at the same time, and an additional medium is not required for this task.

It is furthermore advantageous if the auxiliary lock covers the keyhole for the lock arranged in the door, and, if necessary, also the auxiliary lock, since then the second lock can be used for emergency activation by the bank, after the auxiliary lock has been removed.

It is also possible, however, that the auxiliary lock or a group of auxiliary locks is connected with an input and/or read device, since this makes it possible to keep the control technology expenditure for administration of the lockers which are provided with refitted auxiliary locks slight.

It is also advantageous, however, if the lines of the communications systems are arranged in a housing of the auxiliary lock, since this makes it possible to reduce the wiring expenditure in the area of the locker unit to a minimum.

Finally, however, it is also possible that the housings of the auxiliary locks of adjacent doors are connected with one another via contact devices, which makes it possible for the auxiliary locks to contain not only the security function for the bank lock, but simultaneously also the necessary equipment and systems for energy supply and data transmission.

For a better comprehension of the invention, it will be explained in the following, on the basis of the embodiments shown in the drawings.

Figure 2:
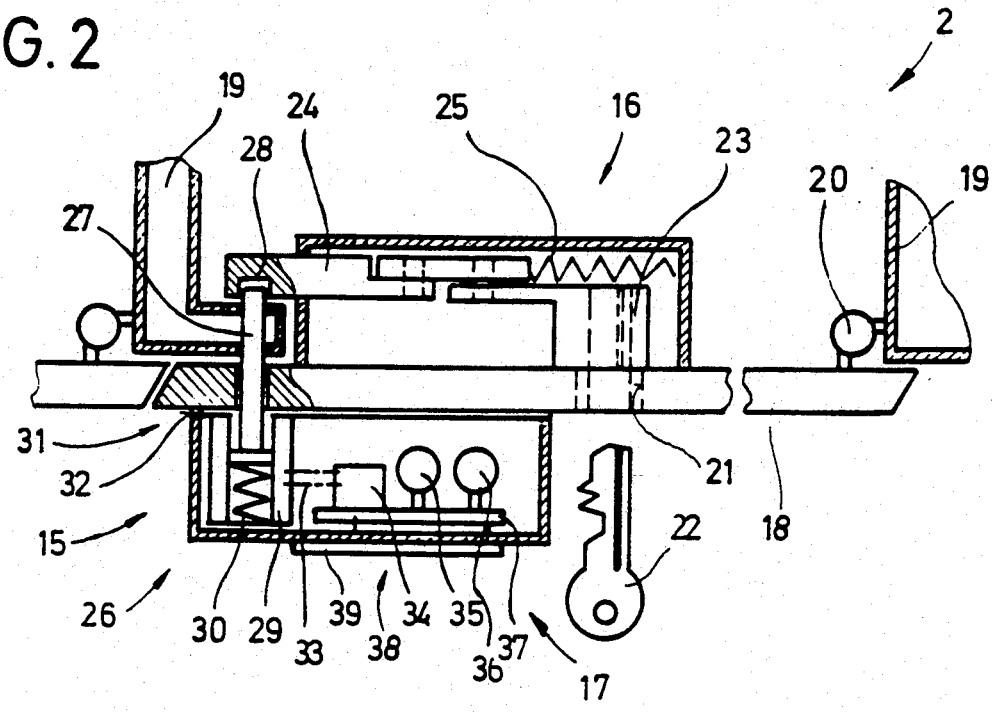
Figure 3:
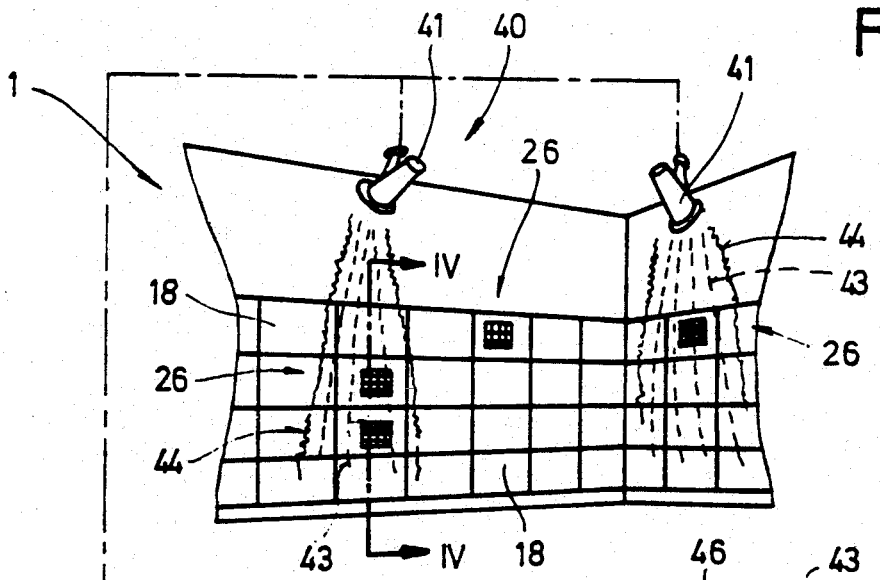
Figure 4:
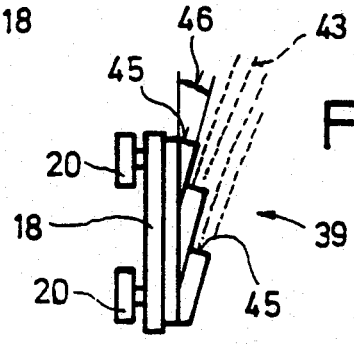
Figure 5:
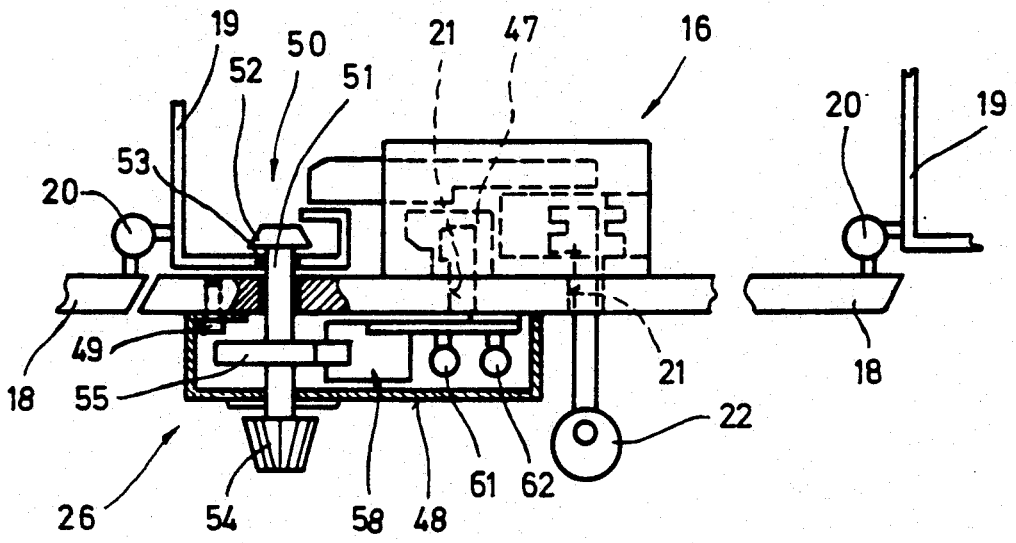
Figure 6:
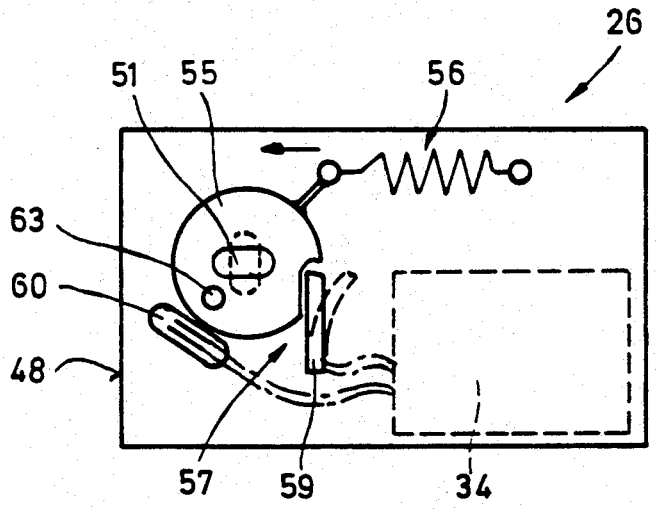
Figure 7:
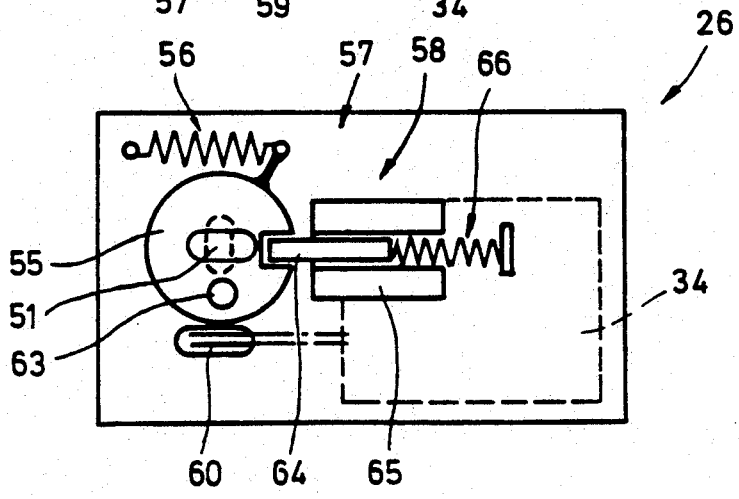
Figure 12:
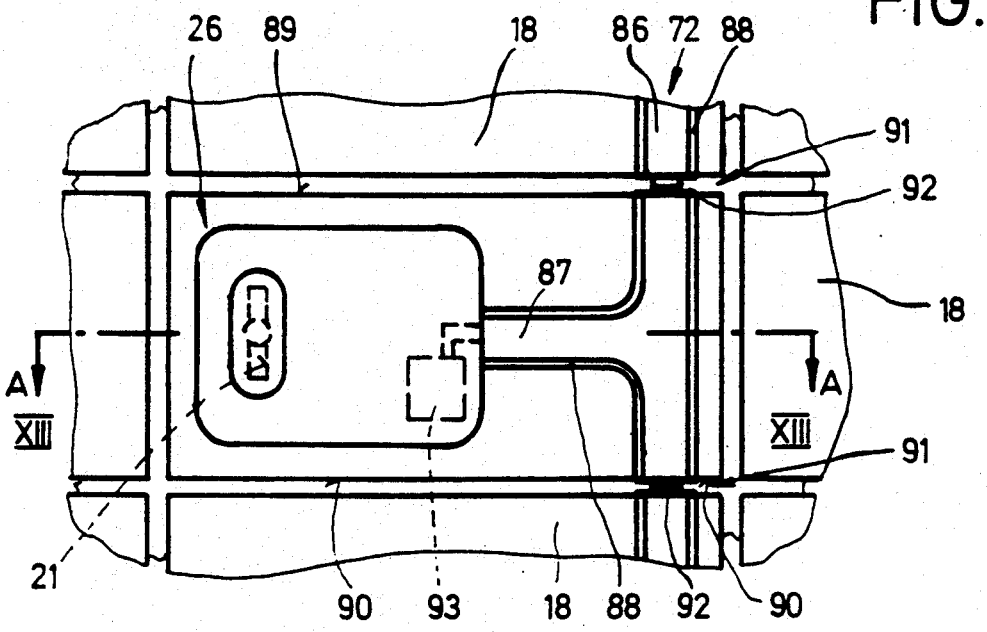
Figure 13:
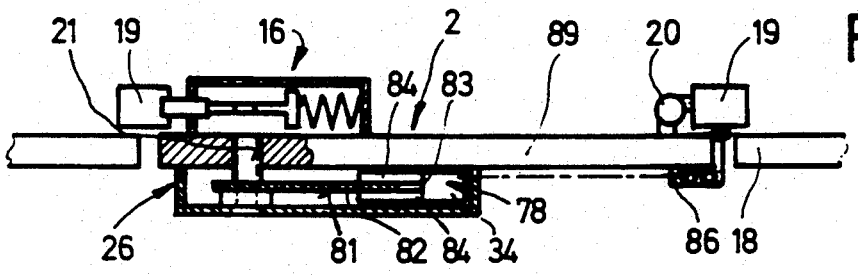
Figure 16:
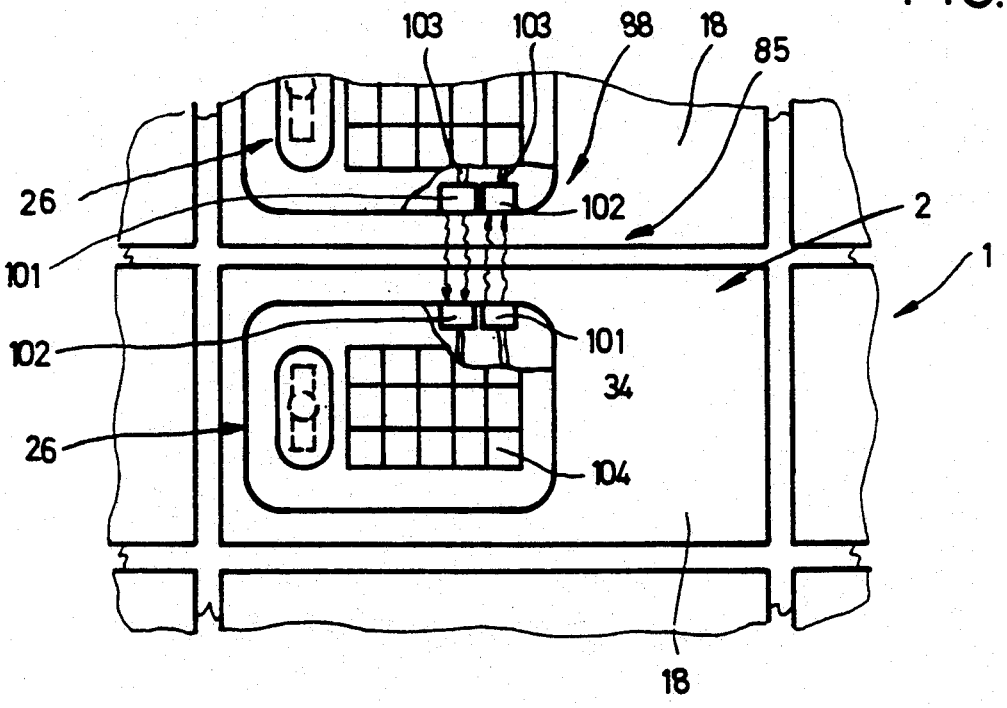
Figure 17:
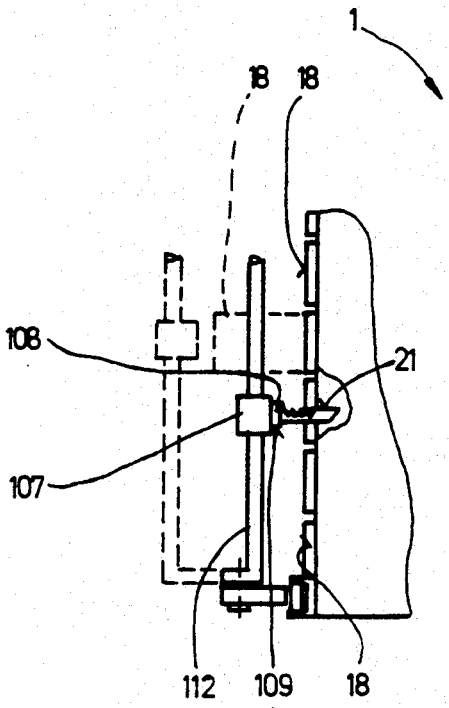
Figure 18:
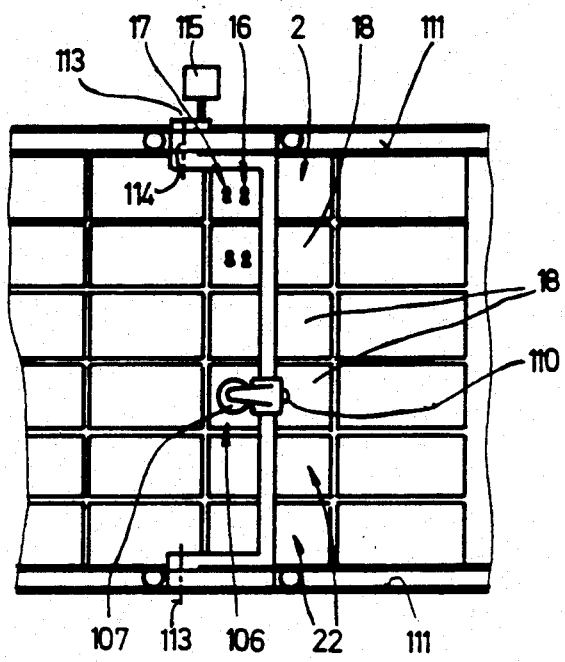
Figure 19:
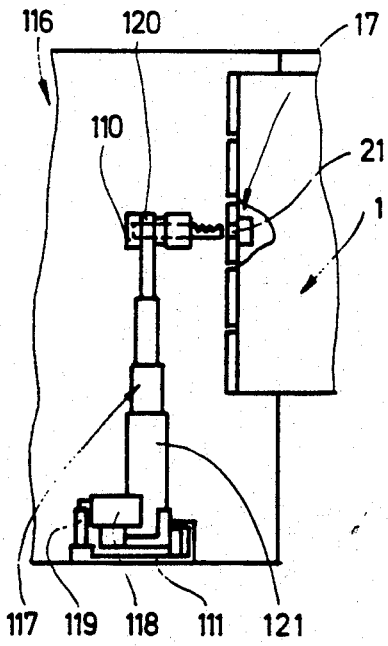
Figure 20:
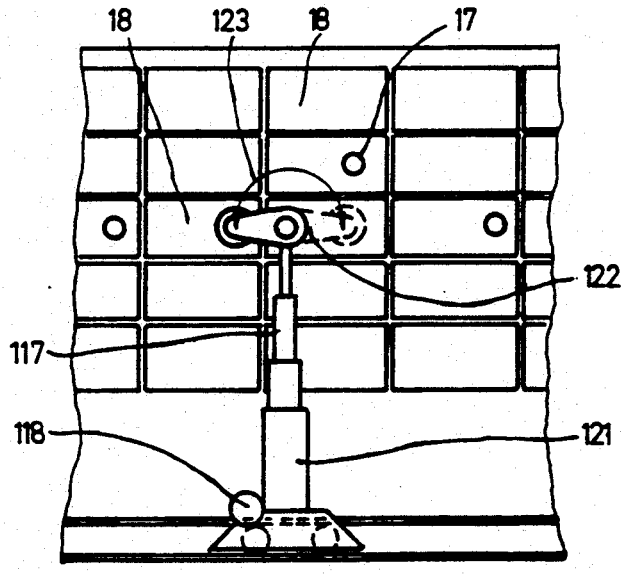
Figure 21:
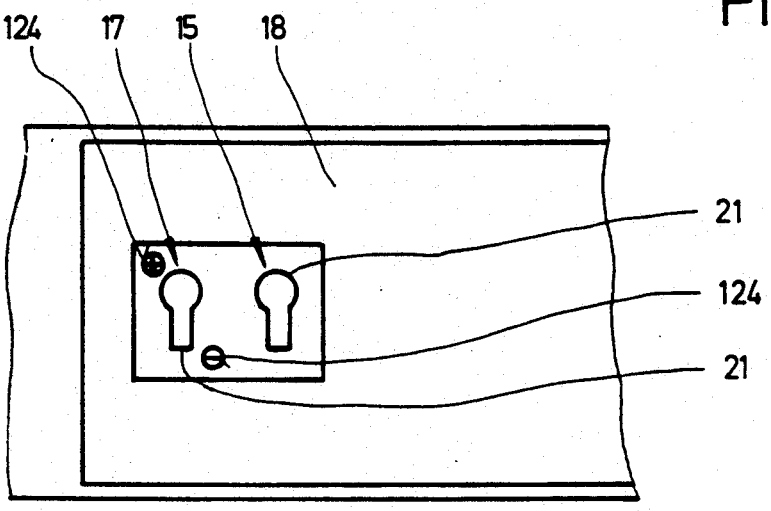
Figure 22:
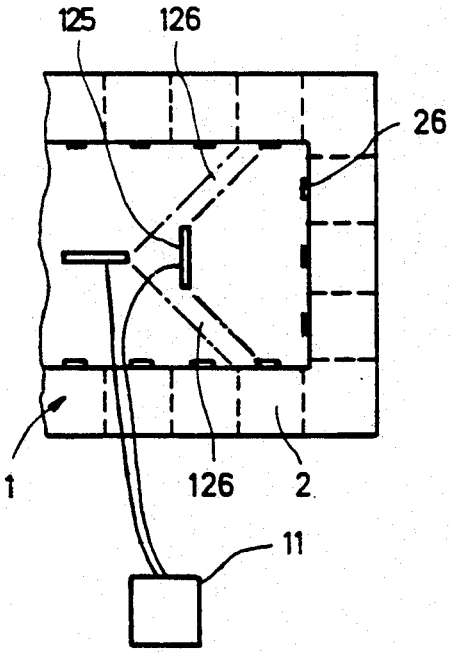
Figure 23:
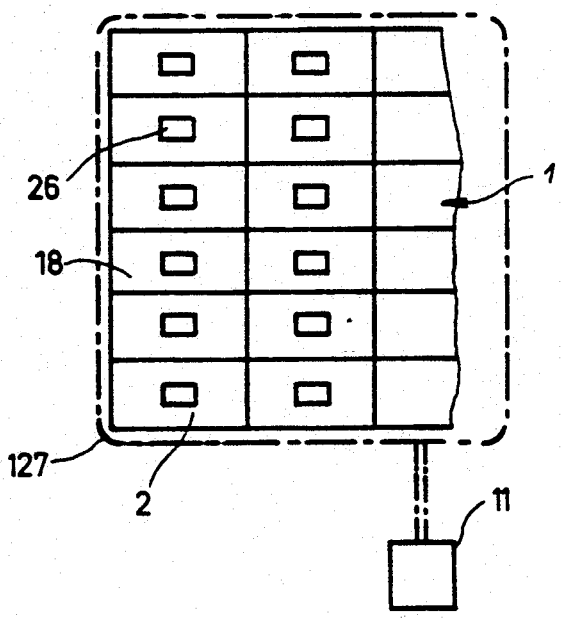
Figure 24:
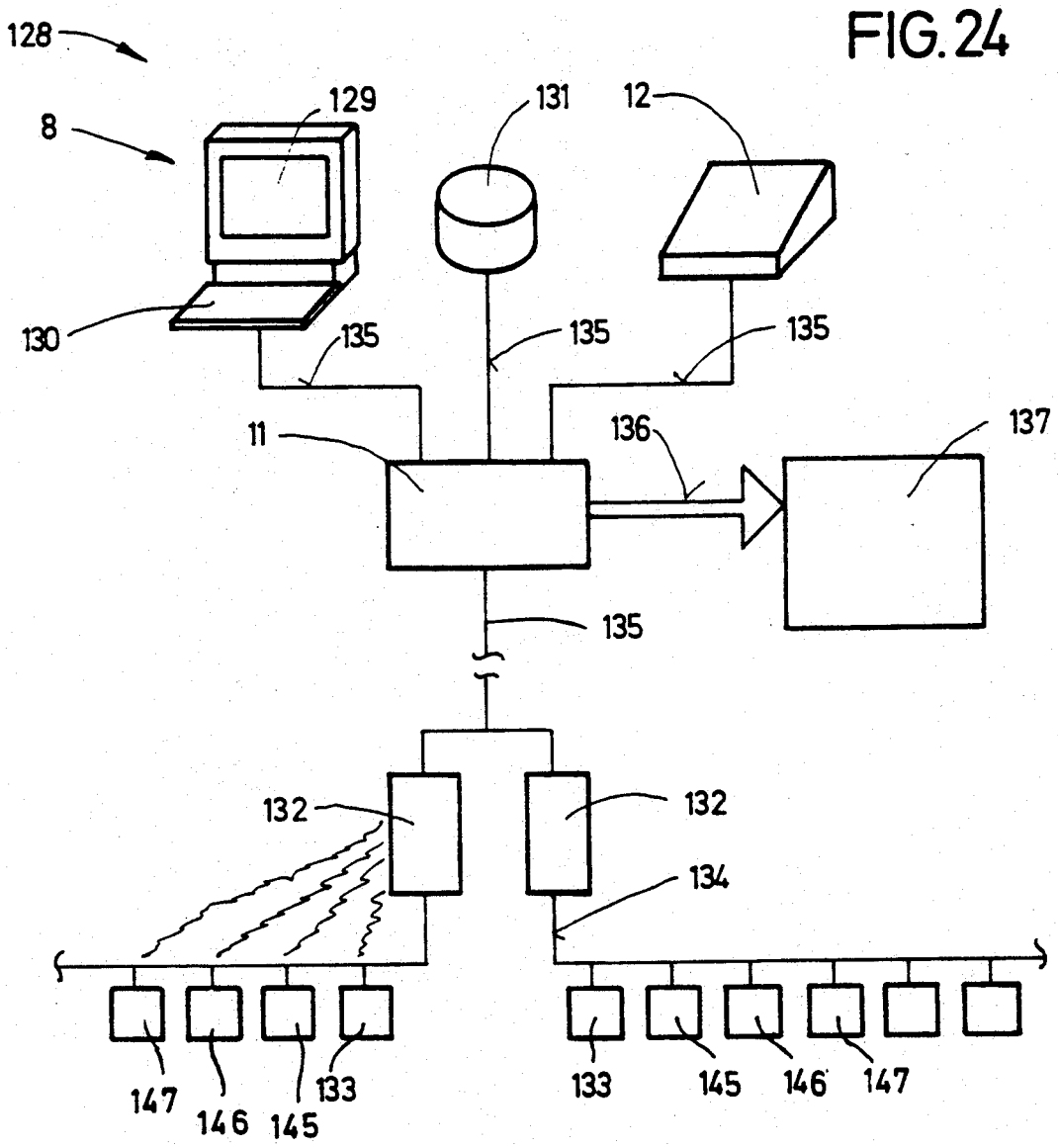
Figure 25:
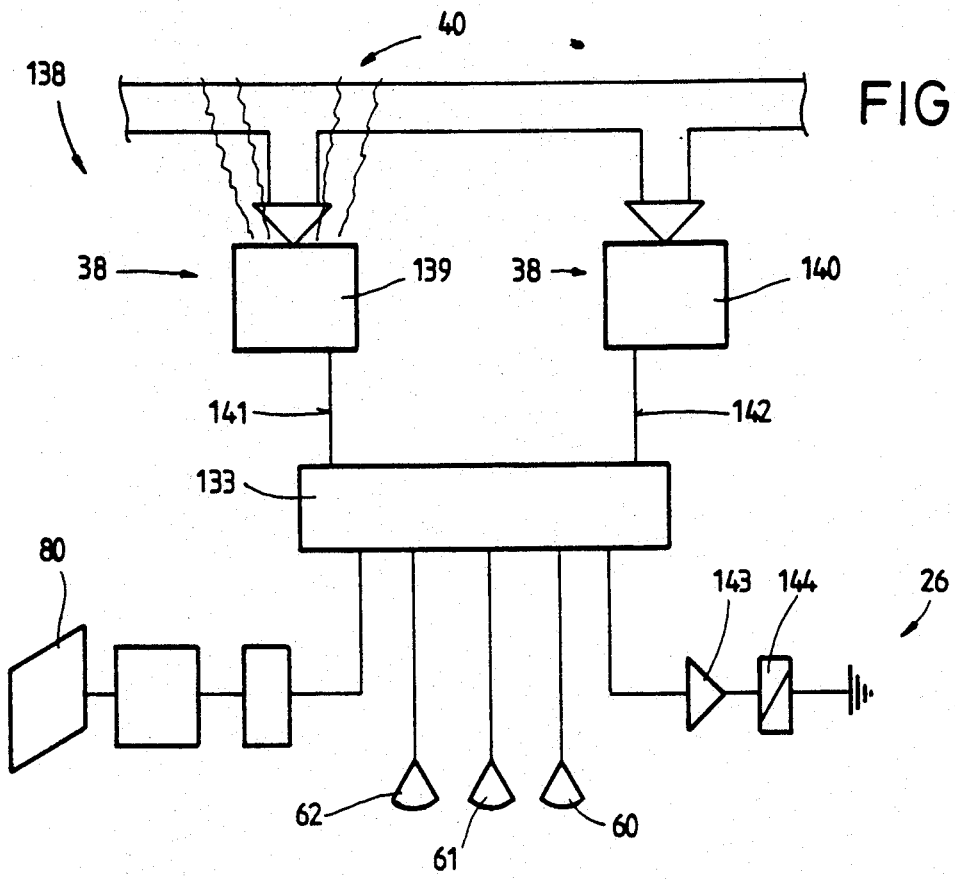
Figure 26:
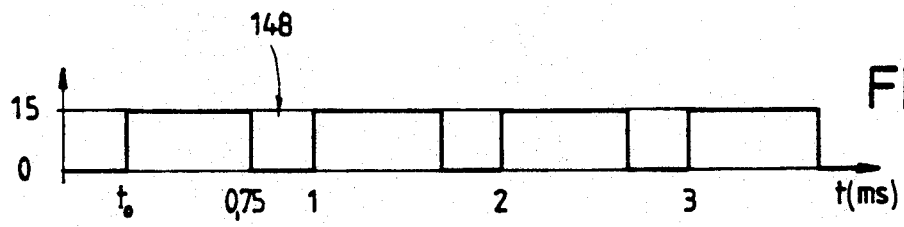
Figure 27:
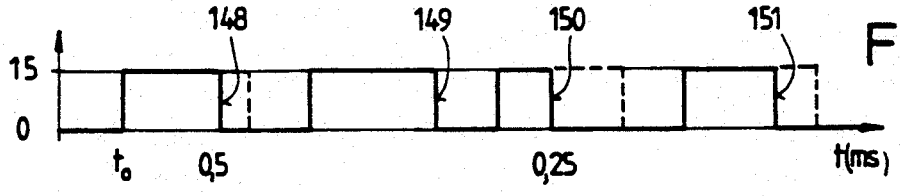
Figure 28:
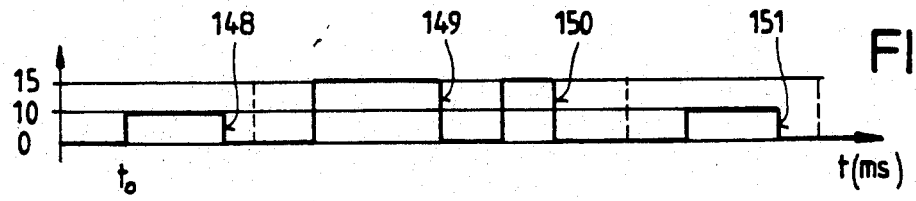
Figure 29:
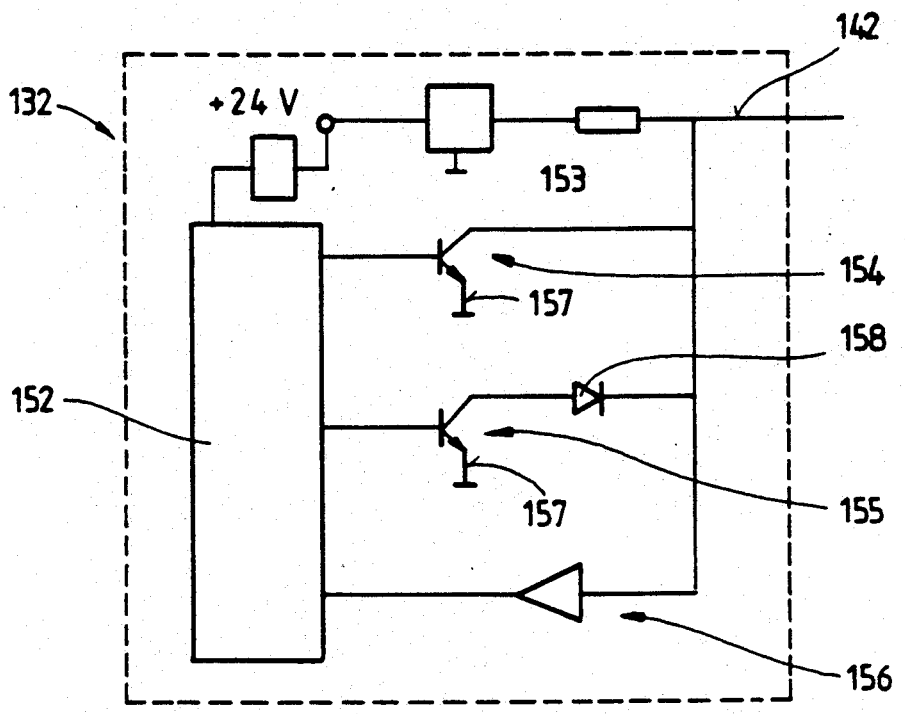
Figure 30:
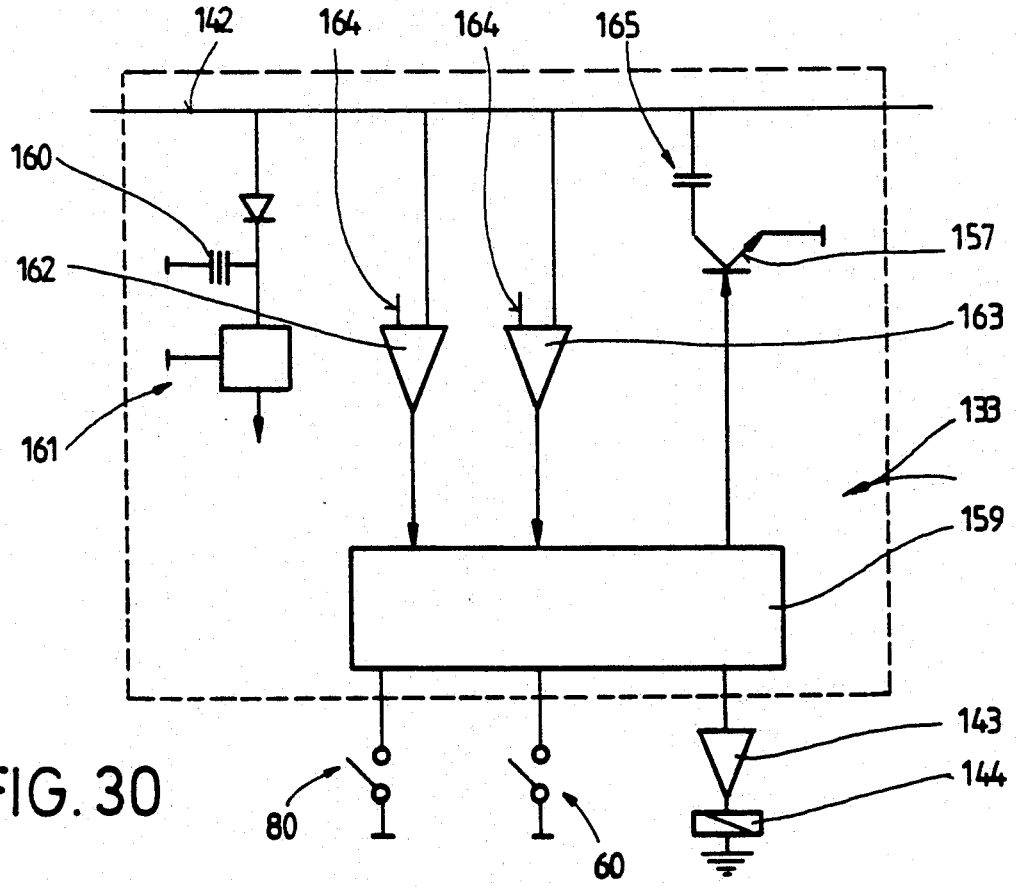
Figure 31:
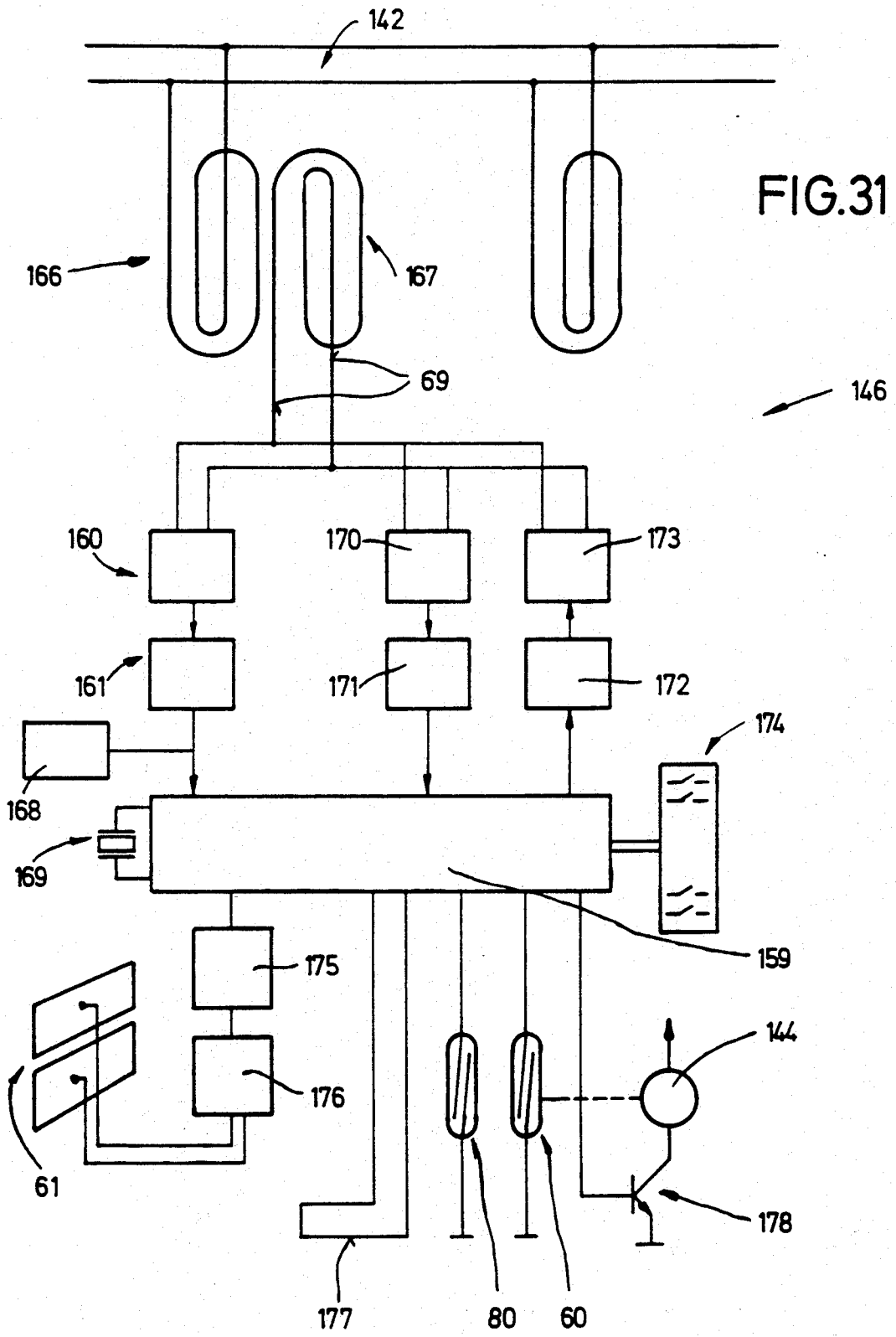

These show:

FIG. 1 a part of the locker unit structured according to the invention, with lockers, vault door, operating table and control electronics, in a simplified schematic representation;

FIG. 2 the locker unit in a frontal view, in cross-section, along the lines II—II in FIG. 1;

FIG. 3 a part of the locker unit on a larger scale, with the locker doors closed;

FIG. 4 the locker unit in a frontal view, in cross-section, along the lines IV—IV in FIG. 3;

FIG. 5 the locker unit in a frontal view, in cross-section, along the lines V—V in FIG. 3;

FIG. 6 an auxiliary lock structured according to the invention, in a frontal view, in partial cross-section;

FIG. 7 another embodiment of the auxiliary lock shown in FIG. 6;

FIG. 8 a communications system between the lockers and a central unit, in a simplified schematic representation;

FIG. 9 a coil for signal transmission, attached at the safe door;

FIG. 10 a coil for signal transmission, attached at the armored wall;

FIG. 11 an auxiliary lock according to the invention in a frontal view, in cross-section;

FIG. 12 an arrangement of the tracks for supply to the auxiliary lock;

FIG. 13 the arrangement of the tracks in cross-section, along lines XIII—XIII in FIG. 12;

FIG. 14 the transition area between the safe door and the safe block in a top view;

FIG. 15 the tracks according to FIG. 13 glued on, in a frontal view, in cross-section;

FIG. 16 a variation according to the invention, for data transmission between auxiliary locks;

FIG. 17 an activation device for unlocking mechanically activated locker doors, in a frontal view;

FIG. 18 the activation device according to FIG. 17 in a side view;

FIG. 19 another embodiment of the activation device in a frontal view;

FIG. 20 the activation device according to FIG. 19 in a side view;

FIG. 21 a locker with marking points for the activation devices shown in FIG. 17 to 20;

FIG. 22 an antenna arrangement for data transmission according to the invention, via electrical or electromagnetic fields, in a top view, and a simplified schematic representation;

FIG. 23 an antenna arrangement for data transmission according to the invention, via electromagnetic or magnetic fields, in a simplified schematic representation;

FIG. 24 a block schematic of a control device structured according to the invention;

FIG. 25 a block schematic of a locker computer module;

FIG. 26 a diagram with the pulse progression of cycle pulses in a line leading to the locker computers;

FIG. 27 a diagram with the pulse progression of cycle pulses modified by the locker computers;

FIG. 28 a diagram with the pulse progression of cycle pulses modified by the locker computers and by the network controller;

FIG. 29 a block schematic of a network controller;

FIG. 30 a block schematic of a locker computer;

FIG. 31 a block schematic of an embodiment for transmission of energy and data to a locker computer;

FIG. 32 another embodiment of an auxiliary lock and a variation for its attachment to a door of a locker in a top view, in partial cross-section and in a simplified schematic representation.

FIG. 1 shows a locker unit 1 comprising a plurality of lockers 2, in a simplified schematic illustration. The locker unit 1 is located, for example, in the vault 3 of a bank 4. Access to the vault is possible via an access door 5, which can be formed by a door with bars, or, during night hours, by an armored door. In order to allow access to the locker unit 1, a monitoring station 7 is set up in the anteroom 6 of the vault 3, or in another room of the bank. This comprises a monitor workstation 8 and, if necessary, a card reader device 9. The monitor workstation 8 and the card reader device 9 are connected, for example, with a central control unit 11 via a data line 10. Furthermore, a record printer 12 and another card reader device 9 located in the area of the access door 5 are also connected to this central control unit 11. Via a bus system 13, or, in the case of smaller units, a corresponding data cable, the locker unit 1 is also connected with the central control unit 11. Each of the lockers 2 is closed with a door 14, which has a locking device 15 assigned to it. This locking device 15 has a mechanical lock 16.

If a user or owner of a locker 2 wants to visit his locker, he must identify himself, for example at the monitor workstation 8, by inserting an identification card similar to a credit card, which has been made available to him, into the card reader, or by filling out and signing a form prepared by the clerk. The clerk then has the opportunity to input the customer number or name of the user via the monitor workstation, and the screen then shows him the corresponding signature or personal data, for example a photograph, so that he can check the person's identity. If checking of the security provisions has yielded positive results, the bank employee can release the locker 2 in question for access by the user, via the monitor workstation and the central control unit 11. The user then goes to the area of the access door 5, where he obtains access to the vault, if necessary after again having his access authorization checked by using the card reader device 9. In the vault 3, he can now open the locker 2 which belongs to him, the auxiliary lock 17 of which is shown schematically and was unlocked via the central control unit 11, i.e. from the monitor workstation 8. This auxiliary lock 17 is usually referred to as a bank lock.

FIG. 2 shows an embodiment of a locking device 15 for a door 18 of a locker 2. These lockers 2 are installed in a corpus which is formed from armored walls 19, between which the doors 18 are inserted, which in turn are attached to the armored walls 19 via hinges 20. This locking device 15 comprises a mechanical lock 16. For activation of the mechanical lock, a keyhole 21 is arranged in the door 18, by way of which a key 22 can be inserted into the lock mechanism 23. The lock mechanism is connected to move with a locking bolt 24. The locking movement of the locking bolt 24 can, if necessary, be supported with a spring 25. An auxiliary lock 26 has a locking pin 27, which is mounted to be adjustable perpendicular to the door 18, and passes through the door 18 as well as through an edged area of the armored wall 19 and engages with a bore 28 in the locking bolt 24. The locking pin 27, which acts as a bolt, is connected with a drive 29, which is formed as an electromagnet, for example. The locking pin 27 is held with tension against the effect of the drive 29, by a spring device 30, so that it engages securely with the locking bolt 24. The auxiliary lock 26 is rigidly attached to the door 18 by means of attachment means 31, e.g. a layer of adhesive 32.

The drive 29 is connected with a control device 34 via lines 33. Measurement value sensors 35 and 36 are assigned to the control device 34, by means of which the position of the auxiliary lock 26 relative to the door 18 can be constantly monitored, i.e. with which the ambient temperatures or vibrations can be determined, in order to determine whether an unauthorized person is attempting to gain access to a locker 2 by force. These measurement value sensors 35 and 36 are preferably attached on a circuit board 37 or a computer board, on which the control device 34 is mounted. The computer board can, of course, also be formed from a cast module which is provided with standardized plug-in devices. It is connected with a solar cell arrangement 39, for example, via a translation component 38, which in turn forms a component of a communications system 40—FIG. 3.

As is better evident from FIG. 3, the communications system consists of emitters 41, which are connected with an energy source 42 as well as the central control unit 11 or any other control computer. The energy required for activation of the drive 29 is symbolically represented by light beams 43, and it is possible that the signals 44, which are schematically shown by a wavy line in the drawing, are superimposed on these light beams 43. This superimposition can take place both for signal transmission from the emitters 41 to the translation component 38, and in the opposite direction. The signal transmission between the translation component 38 and the emitter 41 for passing on signals to the control unit 11 is important so that in case of disturbances or attempts at access by unauthorized third parties, an alarm or an indication to the operator or the bank is given as soon as possible, so that any illegal opening of a locker 2 can be prevented as quickly as possible.

FIG. 4 furthermore shows that the solar cell arrangement 39 can be equipped with solar cells 45 arranged in a scale formation. It is especially advantageous if the individual solar cells are inclined at an angle 46 relative to the vertical, which corresponds to the incident angle of the light beams 43, so that the best possible energy yield of the light beams 45 can be achieved, i.e. so that good signal reception of the signals 44 is ensured. Of course it is also possible that the solar cells 45 are arranged parallel to the doors, as shown in FIG. 3, i.e. that the angle 46 is 90 degrees.

FIG. 5 shows another embodiment for an auxiliary lock 26. The door 18, as was described for FIG. 2, is mounted on armored walls 19 to pivot via hinges 20. On the side of the door 18 facing away from the operator, a mechanical lock 16 is arranged, which is rigidly connected with the door 18. For activation of the lock 16, a key 22 is provided, which can be inserted into the lock 16 via a keyhole 21. For the lock 16, any known mechanical lock with a sufficient degree of security for such purposes of use can be utilized. This mechanical lock can also be provided with an auxiliary lock 47 which works in parallel with the locking device 15, as schematically indicated. If, in order to facilitate operation according to the invention, this auxiliary lock 47 is to be replaced by remote control, a housing 48 of the auxiliary lock 26 is installed in front of the keyhole 21 of the auxiliary lock 47, for example. The housing 48 can, as indicated schematically, be connected with the door 18 with attachment means, for example mechanically via attachment screws 49. The auxiliary lock 26 comprises a locking device 50. This has, among other things, a rotating bolt 51 arranged perpendicular to the door 18. When the door 18 is closed, locking projections 52 pass through the armored wall 19 and can be pivoted into the position shown with solid lines, relative to an opening 53, in which a distance between the points of the two locking projections 52 spaced farthest apart is greater than a width of the opening 53. A height of the opening 53 essentially corresponds to this distance between the points of the two locking projections 52 spaced farthest apart, or is slightly greater. The rotating bolt which holds the locking projections 52 is furthermore connected with an activation button 54 which projects beyond the housing 48, so that the rotating bolt 51 can be activated from outside the locker 2. Furthermore, a locking element 55 is connected to rotate with the locking bolt 51, as is schematically indicated by weld seams between the rotating bolt 51 and the locking element 55, which can be formed by a disk.

As is better evident from FIG. 6, the locking element 55 is jointed to a spring device 56, which is mounted in the housing 48 with its end facing away from the rotating bolt 51. With this spring device 56, a tension acting in the closed position, schematically indicated by an arrow, is exerted on the rotating bolt 51. The spring device 56 therefore attempts to always keep the locking projections 52 in their position which corresponds to the closed position, and is shown with solid lines in FIG. 5. Now in order to allow activation of the rotating bolt 51 only if an authorized user wants to open the door 18 of his locker 2, a stop device 57 is provided. This consists, in the example shown in FIG. 6, of a drive 58, e.g. a piezo drive, and a bolt 59 which works together with it, which engages in a recess of the disk-shaped locking element 55 in its rest position, shown with solid lines. If an unauthorized user now tries to turn the rotating bolt 51 into the open direction with the activation button 54, this is not possible, since rotation of the disk-shaped locking element 55 is prevented by the bolt 59. If, on the other hand, access to the locker 2 has been released by the bank, power is supplied to the bolt 59 via the control device 34, i.e. it deforms in the direction indicated with dot-dash lines, due to its inherent material properties. Therefore it moves out of the circumference area of the disk-shaped locking element 55, and the rotating bolt 51 can now be moved against the tension indicated by the—arrow—into its open position, in which the locking projections 52 can pass through the opening 53. If the authorized user has previously opened the mechanical lock with the key 22, he now has free access to his locker 2. The supply to the control device 34 can come via lines, or it is also possible to carry out energy and signal transmission via light beams 43, as was described on the basis of FIG. 3 and 4. In this case, solar cells 45 would have to be arranged on the housing 48.

In order to prevent the auxiliary lock 26 from being removed from the door 18 without authorization, i.e. in order to be able to monitor the desired position of the disk-shaped locking element, several measurement value sensors 60 to 62 are arranged. The measurement value sensor 60 monitors the position of a monitor tab 63 on the disk-shaped locking element 55. If the monitor tab 63 is rotated out of the position shown, the measurement value sensor 60, which can be formed by an electromagnetically activated approximation switch, for example, is activated and issues a corresponding control signal to the control device 34. The measurement value sensor 62 can be structured similar to the measurement value sensor 60, in order to monitor, for example, whether the auxiliary lock 26 is maintaining its pre-set position relative to the door 18. If the auxiliary lock 26 is removed from the door 18 in authorized manner, the magnetic field changes and the control device 34 can be informed, with a corresponding monitoring signal, so that an external alarm can be triggered. The measurement value sensor 61 can be a vibration sensor, combined with or separate from a temperature sensor, so that in case of impermissible vibrations, such as those which would occur if a locker were opened with a jimmy or crowbar, or at temperatures which are above permissible temperatures, due to a welding process or something similar, a signal is also passed on to the control device 34, which results in triggering of an external alarm. Of course any other element which can be adjusted under the effect of current or temperature, for example a bimetallic or memory metal element, can be used instead of a piezo element.

FIG. 7 shows an embodiment variation of the stop device 57. In this embodiment, the disk-shaped locking element 55 has a stop tab 64 assigned to it, which is adjustable radially to the disk-shaped locking element 55, against the effect of a spring 66, via an electromagnet 65. The stop tab 64 can, at the same time, also form the movable core of the electromagnet 65. If the electromagnet 65 is now activated before an authorized opening of the door 18, the stop tab in the electromagnet is pulled in, against the effect of the spring 66, and movement of the rotating bolt 51 is released. This makes it possible to move the rotating bolt 51 into an open position, against the effect of the spring device 56, as described on the basis of FIG. 5 and 6.

FIG. 8 to 11 show another embodiment of an auxiliary lock 26. In this embodiment again, the auxiliary lock 26 is installed on the door 18 of a locker 2. Each door 18 of a locker 2 is connected with the armored wall 19 via hinges 20. The armored walls have an angled structure and the locking bolt 24 of the mechanical lock 16 engages behind them. This makes it possible to lock the door 18 in its closed position relative to the armored wall 19. To provide power to the auxiliary lock 26, tracks 67, 68 are arranged on the armored wall 19 and on the side of the door 18 facing this wall. The track 67 on the door 18 is connected with the auxiliary lock 26. i.e. with the control device 34 arranged in it, via lines 69. The mechanical lock 16 can be formed by any known mechanical lock from the state of the art, so that the auxiliary lock 26 can especially be used to refit doors 18 of lockers 2 which are equipped with a normal double lock for a so-called "bank key" and a "customer key." The keyhole 21 originally provided for activation of the "bank lock" is preferably covered by the auxiliary lock 26 in this case. An opening 70 for activation of the "customer lock" is passed through the auxiliary lock 26, so that the bank customer can lock the lock 16 through the auxiliary lock 26, using the key he has used previously, after the auxiliary lock 26 has been installed. Attachment of the auxiliary lock 26 to the door 18 can take place by means of screws, adhesive or welding.

FIG. 9 and 10 now show the structure and arrangement of the tracks 67 and 68 on a larger scale. Each of these tracks 67 and 68 forms a coil, with this coil being produced of a conductive adhesive strip or sprayed onto an insulating film 71 with conductive paint. This film can be glued directly to the side of the door 18 facing towards the armored wall 19, and make contact with the lines 69 passing through the door 18. It is also possible, however, that the conductive strip—as is schematically indicated with broken lines in the area of the auxiliary lock—is wrapped around the door 18' so that drilling through the door 18 can be avoided and the control device 34 can make contact with the track 67 directly on the outside of the door 18.

Now in order to supply the coil formed by the track 67 with energy by induction, the track 68 also forms a coil on the armored wall 19, which supplies with an energy system via lines 72, which can also be formed by tracks applied on self-adhesive foils or by conductive foils which are self-adhesive. By appropriately applying alternating current to the coil formed by the track 68, a voltage is induced in the track 67 and the coil formed from it, which can be used to supply energy to the auxiliary lock 26. By suitable modulation of the alternating current, data or control signals can be transmitted from a central control unit to the control device 34, in addition to energy, by this path.

FIG. 11 shows the structure of the auxiliary lock 26 in detail. A locking element 73 is formed by a shutter 74, which is provided with gearing 75 over at least part of its circumference. The shutter 74 is mounted to rotate about an axis 76. In addition, it has a recess 77, which is arranged to align with and cover the keyhole 21 in the open position of the shutter 74, as shown in FIG. 1. On the locking element 73, there is furthermore a monitor tab 63, which can also be formed by a metal film glued on or a metal part installed in the locking element 73, which is assigned to the measurement value sensor 60 in the position of the locking element 63 as shown, with which the position of the shutter 74 can be monitored. The measurement value sensor 60, is connected with the control device 34, as are the additional measurement value sensors 61, 62, which can exercise the same or a similar function as described on the basis of FIG. 5 to 7. The control device 34 is supplied with energy and with signals, i.e. data via the lines 69, by the track 67 structured as a receiver coil. For this purpose, the lines 69 are passed through an opening in the door 18. A drive 78 for a gear wheel 79 is furthermore connected with the control device 34. This drive can be formed by a stepper motor or a disk-shaped linear motor or any other motor. It is advantageous if this motor has a very low structural height, since then the auxiliary lock 26 can also be produced with a very low structural height.

The operation of the auxiliary lock 26 is now such that when the lock 16 is released, the shutter 74 is pivoted with the drive 78, for example from a position in which the recess 77 is in a position shown with broken lines, in which access to the keyhole 21 is blocked by the shutter 74, into the position of the recess 77 shown with solid lines, with the drive 78. Reaching of this end position is monitored by the interaction of the monitor tab 63 and the measurement value sensor 60. Furthermore, a measurement value sensor 80 can also be arranged in the area of the recess 77. By the interaction of the measurement value sensors 60 and 80, it is then possible to precisely monitor the position of the shutter 74 at any time, since the closed or locking position of the shutter 74 is signalled if the output of the measurement value sensor 80 is busy, while if the shutter 74 is in the open position, the output of the measurement value sensor 60 is giving a signal. At the same time, the measurement value sensor 80 can be used to monitor the presence of a key when the shutter 74 is in the open position. This would mean that if both the measurement value sensors 60 and 80 are giving off signals, the shutter 74 is in the open position and a key is inserted in the keyhole 21. At the same time, this monitoring could be used to enable the keyhole 21 to be closed with the shutter 74 again automatically, immediately after the lock 16 is locked and the key is removed from the keyhole 21. This would additionally shorten the time period during which an unauthorized user could manipulate the lock. When using a drive 78 with a flat construction, it is therefore possible to structure the auxiliary lock 26 in the manner of a slightly thicker credit card. This can then more easily be applied to the door 18 by means of a gluing process. Instead of the motor 78, of course, a drive with a rotary magnet can also be provided, i.e. the keyhole 21 can also be blocked by locking pins activated by a magnet.

FIG. 12 and 13 show another embodiment for an auxiliary lock 26. This auxiliary lock 26 is again attached on the side of the door 18 which faces the user, as is better evident from FIG. 13. The structure of the auxiliary lock 26 can essentially correspond to the embodiment of the auxiliary lock 26 according to FIG. 8 and 11, so that the same reference numbers are used for the same parts. The doors 18 are attached to the armored walls 19, i.e. to the armor framework, via hinges 20. On the side of the door 18 which faces towards the inside of the locker 2, a mechanical lock 16 is arranged, which can be locked with a key, which can be inserted into the lock 16 through a keyhole 21, through the door 18. Access to the keyhole 21 can be prevented by a locking plate 81. This locking plate is structured as the movable rotor 82 of a linear motor 83 in part of its area, to which stators 84 are assigned. The linear motor 83 forms the drive 78 for the locking plate 81. By changing the polarity of the stators 84, the locking plate 81 can be alternately moved in the direction of the keyhole 21 or away from it. This makes it possible to achieve release or locking of the keyhole 21 with simple means, which also offer the advantage that they require only a slight structural depth.

A communications system 85 between the central control unit 11 and the control devices 34 assigned to the individual auxiliary locks 26 is formed by tracks 86, 87. These tracks 86, 87 consist, for example, of an electrically conductive, especially an electrically semi-conductive plastic, which is applied to an insulating layer 88. This application of the insulating layer 88 as well as of the tracks 86, 87 to the doors 18 can take place in such a way that the individual layers are sprayed or evaporated onto the doors consecutively, or it is also possible to structure the insulating layer 88 and the track 86 as a strip of film, preferably self-adhesive, which is then merely applied to the fronts of the doors as well as their frontal edges 89, 90. Between the individual doors 18, contact devices 91 are arranged to connect the tracks 86 between the individual doors, i.e. to connect the tracks 86 with an armored wall 19, which forms the corpus of the locker unit. These contact devices can have spring-loaded contacts 92, for example, in order to come into contact with the track 86 in the area of the frontal edge 89. This ensures an undisturbed connection between the tracks 86 and sufficient security in the transmission of energy and data between the individual doors 18. As is schematically indicated in FIG. 12, the track is coupled with an energy storage in the area of the auxiliary lock 26. This energy storage 93, which can be formed by a battery or something similar, is used as a so-called buffer storage, so that certain functions of the auxiliary lock 26 can also be carried out in the open state.

FIG. 14 shows how even when the door 18 is opened, sufficient supply to the individual control devices 34 in the auxiliary locks 26 can be ensured. For this, tracks 94 are arranged on the corpus or the stays or armored walls 19, which can be arranged on the armored wall 19 using an elastically deformable carrier layer 95, in the area of the doors, for example. With this parallel circuit of the tracks 94 arranged on the armored wall and the tracks 86 on the doors 18, a connection and supply to the other doors can be maintained even if one of the doors 18 is opened. Of course it is also possible, however, to structure the tracks 86 and 87 in multi-track form, so that feed and supply of the individual control devices 34 of the doors 18 can be carried out from any side, or it is also possible to use a corresponding control logic circuit in the central control unit 11 to prevent more than one locker 2 from being released for access, in a series of lockers 2 arranged one on top of the other.

FIG. 15 shows a line 96 which can be used to produce the tracks 86, 87. This line consists of an insulating layer 88 which forms a carrier layer, onto which a self-adhesive layer 97 is applied on one side, and tracks 98, 99 and 100 are applied to the opposite side. Of course, even more tracks can be arranged on this insulating layer 88, parallel to one another. This makes it possible to separate the signal lines from the energy supply lines or to structure different power circuits, via which the individual doors are supplied, for example alternately.

FIG. 16 shows another type of a communications system 85 for supplying the energy to the auxiliary locks 26 on doors 18, arranged on top of or next to each other, of lockers 2 of a locker unit 1. On each of the doors 18, auxiliary locks 26 are arranged, which can be structured, for example, according to the embodiments described above. For energy supply of the individual auxiliary locks 26, the communications system 85 is now in wireless form. The transmission of energy and data or messages between the auxiliary locks 26 now takes place via transmission elements 101, 102 arranged in the auxiliary locks 26 and facing each other. These transmission elements can be formed, in the simplest embodiment, by transmission and reception lenses for optical fibers 103 connected to these. It is also possible, of course, that these are light-emitting or laser diodes as the transmitter unit and corresponding light-sensitive elements as receiver units. This makes it possible to transmit various signal sequences and also energy. The energy transmission can take place with light waves, magnetic waves or by induction. In the latter case, the transmission elements 101, 102 consist of appropriately structured coils.

The transmission elements 101 and 102 are in a circuit with the control device 34 arranged in the auxiliary lock in question; a keypad 104, for example, can also be connected to this. Various data can be input to the control device 34 using the keypad 104. The advantage of such an arrangement is that double security is created for the user of a locker 2, since in addition to his "customer key" a personal code can also be input into the control device 34, without which the locking plate 81 does not release the keyhole 21, for example.

FIG. 17 and 18 show another embodiment for automation of an existing locker unit. The existing unit consists of lockers 2, the doors 18 of which are locked with a mechanical lock 16. The lock 16 has two mechanical locking mechanisms, the so-called auxiliary lock 17 and the locking device 15. These locking mechanisms can either have two separate keyholes or one common keyhole. Almost all existing, non-electrical rental locker units are structured In this way. Only one common activation device 106 is assigned to a group of doors 18, which is remote-controlled from the operator location of the bank, and can activate the auxiliary lock 17 of the locks 16. To activate the bank lock, a drive 107, for example a rotary drive, is present on the activation device 106. The rotary drive is rigidly connected to rotate with a key 108. The drive 107 with the key 108 is connected with a setting drive 110 in a guide track 109, which is aligned perpendicular to the door fronts of the doors 18. Using this setting drive 110, the drive 107 with the key 108 can be inserted into the keyhole 21 of the auxiliary lock 17. Once the key 108 has engaged in the auxiliary lock 17, it can be pivoted into an open position with the drive 107. This unlocks the auxiliary lock 17. Then the key 108 with the setting drive 110 can be removed from the keyhole 21, and the activation device 106 can move into a rest position to the side of the locker 2 to be opened. In order to allow movement along guide tracks 111 into a rest position even if doors 18 which are opened during this movement are in the way—as shown in FIG. 17—a carrier arm 112 of the activation device 106 can be pivoted from a position adjacent to the doors 18 to a position farther away from them. For this, the carrier arm 112 is arranged on pivot axes 113 of carriages 114 which can be moved in the guide tracks 111. To pivot the carrier arm 112 around the pivot axes 113, a pivot drive 115 is provided, which is coupled to rotate with one of the two pivot axes 113.

With this central activation device 106 it is now possible to automate existing locker units 1 with a plurality of lockers 2, which are secured with two mechanical locks, so that no bank personnel is needed any longer to accompany the customer when he opens his locker. Opening of the bank lock can now take place via the central activation element 106, before the customer enters the locker area, whereupon he can open the locker with his customer key. The "bank lock" formed by the auxiliary lock 17 either engages automatically when the "customer lock," namely the lock 16, is closed, or it can be locked fully automatically after the customer has left the vault, using the activation device 106.

FIG. 19 and 20 show another embodiment of a central activation device 116 for a plurality of auxiliary locks 17 arranged in doors 18 of lockers 2. This essentially consists of a robot 117 which can be moved along a guide track 111. For movement along the guide track 111, the robot is provided with a locomotion drive 118, which consists, for example, of an electrical motor with a pinion on a flange, which engages with a rack 119 arranged on the guide track 111. A working head 120 of the robot 117 is adjustable via a height adjustment drive 121, formed, for example, by a telescoping cylinder, to the position of the auxiliary lock of the door 18 to be opened. Positioning of the working head 120 along the guide track 111 is carried out via the movement drive 118. In the working head there is a drive 107 for the key 108, which engages with a keyhole 21 of the auxiliary lock 26. After the working head 120 has been centered on the keyhole 21 of the auxiliary lock 17, it can be inserted into the keyhole 21 via a setting drive 110, and then be rotated in its open position using the drive 107. Once the auxiliary lock 26 which forms the "bank lock" has been opened, the key 108 can be retracted from the keyhole 21 by means of the setting drive 110, and the robot 117 can be brought to its end position.

Given the design of the robot 117, i.e. its height adjustment drive 121, it is possible to lower the working head 120 into an area below the locker unit 1 after the auxiliary lock 26 has been locked or unlocked, so that the head can be moved into a predefined rest position without the danger of a collision with an open door 18.

It is also possible to arrange the working head 120 on a pivot arm 122, so that the robot 117 can maintain the position it has taken to open the auxiliary lock 26, and the working head 120 can simply be pivoted into the position shown with broken lines—as indicated by an arrow 123—so that access to any door 18 for which the auxiliary lock 17 was unlocked is free.

FIG. 21 shows a part of a door 18, which is provided with two keyholes 21 for a mechanical lock 16 and an auxiliary lock 17. In order to allow centering of the working head 120 or the key 108 with the activation device 106 or 116, markings 124 with reference to the keyhole 21 are arranged adjacent to the keyhole 21, which can be scanned with sensors in the working head 120 or on both sides of the key 108, in order to allow perfect insertion of the key 108 into the keyhole 21 of the lock.

FIG. 22 and 23 show the possibility of wireless energy transmission via electrical, magnetic or electromagnetic fields. This principle is of particular importance for the automation of existing, purely mechanical locker units, since little intervention in the existing unit is necessary.

FIG. 22 shows a locker unit 1 in a top view, the lockers 2 are located along the walls. In the center of the room, antennae 125 are set up; these radiate energy to supply the auxiliary locks 26, and also emit the signal data necessary to control the locks, and receive the answering signals from the auxiliary locks. These antennae are, in turn, connected with the central control unit 11. The lines 126 indicate the area covered by the antennae.

FIG. 23 shows another solution variation according to the invention. The figure shows a wall of the locker unit 1 with the lockers 2. On the doors 18, there are the auxiliary locks 26. Around this block of lockers, a frame antenna 127 is placed, which again is connected with the central control unit and emits both energy and data, and also receives data from the auxiliary locks. The auxiliary locks 26, which can be structured in one of the variations described above, also have an integrated antenna, e.g. in the form of a coil similar to FIG. 9, which is in interaction with the frame antenna 127 and handles the data and energy transmission in this way.

FIG. 24 shows a block schematic of a control device 128, as it was schematically indicated in FIG. 1. This control device comprises a monitor workstation 8 comprised of a monitor 129 and a keyboard 130, a large-capacity memory 131 and one or more printers 12 to record the individual control procedures; linking of the monitors 129, the keyboards 130, the large-capacity memory 131, as well as the printers 12, and output of the corresponding control commands to a network controller 132 takes place via the central control unit 11. Locker computers assigned to each individual locker 2, each of which is designated as 133, are connected with this network controller 132 via lines 134. Up to 2048 locker computers can be connected with each network controller, if the system is designed appropriately. Connection of the network controllers 132 with the locker computers 133 can take place via a four-lead safe bus 135 with power supply and half-duplex data transmission, e.g. RS 422. Connection of the central control unit 11 with the monitor 129 and the keyboard 130, as well as the large-capacity memory 131 and the printer 12, can take place via serial standard interfaces, e.g. RS 232 or RS 422, or according to any protocol program that can be freely determined.

In addition, it is also possible to make the connection between the network controller 132 and the locker computers 133 assigned to it, as described on the basis of the previous figures, via optical connections, for example modulated infrared light, photoconductors or via magnetic fields, e.g. inductively or with high frequency, with special reference being made to the illustrations and explanations of FIG. 3, FIG. 9 and 10 and FIG. 22, 23.

These additional transmission possibilities were indicated schematically with thin wavy lines between the network controller 132 and the locker computers 133 assigned to it.

Furthermore, it is possible to bring the central control unit into a circuit with a mainframe computer 137, via a serial interface or an additional bus system 136.

FIG. 25 shows the basic structure of a locker computer module 138 via the safe bus 135 or an optical or magnetic communications system 40—which is schematically indicated with wavy lines—an energy converter 139 and a data transmitter and receiver 140, each of which forms a translation component 38, are supplied with energy or data. These are appropriately taken in and brought into a form in which the subsequent locker computer 133 can process them, with the energy being fed to the locker computer 133 via a line 141, and the data being fed via a line 142. A drive 144 for an auxiliary lock 26 is also arranged on the locker computer, if necessary, with an amplifier 143 in between in the circuit. Furthermore, measurement value sensors 60, 61, 62 and 80 are connected with the locker computer 133. The measurement value sensor 60 can be used to determine whether the lock is locked or open. The measurement value sensor 61 makes it possible to determine whether an undesirably and/or impermissibly high temperature is occurring, and accordingly, if lockers are being opened by force, for example. The measurement value sensor 62 can be used to determine whether the door 18 is open or closed. The measurement value sensor 80 can be formed by a capacitive sensor which acts as protection against vandalism. The signals coming from the individual measurement value sensors are checked in the locker computer 133, validated, if necessary, and passed to the data transmitter and receiver 140 via the line 142. There they are reformatted into the safe bus 135, in accordance with the protocol being used, and transmitted to the central control unit 11 via the safe bus 135.

This transmission of signals from the central control unit 11 to the data transmitter and receiver 140, i.e. from the latter back to the central control unit 11, can be achieved by a suitable modification in cycle pulses.

The progression of such a control and monitoring procedure is shown in FIG. 26 to 28, using the example of the signal sequence in a safe bus 135. FIG. 26 shows a pulse progression, with the voltage in volts being entered on the abscissa and the time in milliseconds being entered on the ordinate. The voltage level on line 142 is 15 volts, for example, with the locker computer 33 reducing the voltage to 0 volts via an open collector output, at intervals of one ms, for approximately 0.25 ms. This results in successive cycle pulses 148.

This theoretical voltage progression on the line 142 is now modified in the form described in FIG. 27 and FIG. 28, if the network controller 132 is connected with a plurality of locker computers 133, 145, 146 and 147—FIG. 24. To differentiate the locker computers, these are provided with an address internal to the system. Thus, the address for the locker computer 133 is "0" for example, and "1, 2, 3" for the locker computers 145, 146, 147. In both figures, the voltage progression on the line 142 is represented according to the representation in FIG. 26. Here, the voltage progression in FIG. 27 shows the changes which are caused by the locker computers 133, while the voltage progression in FIG. 28 also shows, in addition, the changes in the voltage progression that can be caused by the network controller 132. As will be shown subsequently using block schematics of the network controller 132 and the locker computer 133, each locker computer 133 counts along with the cycle pulses 148, with the assumption being made, to explain the control procedure, that a control sequence starts at the time t0, i.e. because of the increase in voltage on the line 142 from 0 volts to 15 volts, the locker computer 133 assigned to the locker with the address "0"knows as is shown in FIG. 24 using the right-hand group of locker computers—that it is being called up. If the locker is now properly closed, which is assumed in the present case, then the voltage level on the line 142 is already decreased to 0 volts after 0.5 ms, not, as is shown with broken lines, after 0.75 ms. Since the network controller 132 is also connected with the line 142, it determines this premature drop in voltage and can therefore determine this as confirmation from the locker computer 133 that the door of the locker is properly closed.

After elapse of one ms, the voltage on the line 142 goes back up to 15 volts, which causes a locker computer 145—FIG. 24—to be called up. If it is now assumed that this locker with the internal address of "1" is open, the voltage progression on this line 142 remains unchanged, i.e. the voltage of 15 volts continues for 0.75 ms. This allows the network controller 132 to determine that the door of the locker with the address "1" is open. A cycle pulse 149 is therefore unchanged as compared with the cycle progression shown in FIG. 26.

After the voltage on the line 142 has gone back up to 15 volts again after the cycle pulse 149, this activates a locker computer 146 of a third locker with the internal address "2." In this, it is assumed that the locker assigned to the locker computer 146 is defective. Accordingly, a cycle pulse 150 already starts after 0.25 ms, for example, and the voltage on the line already drops back to 0 volts after this time. This allows the network controller to determine that the locker with the address "2" is defective.

After the end of the cycle pulse 150, the voltage then goes back up to 15 volts, which causes another locker computer 147 with the address "3" to activate. In this case, just as in the case of the locker computer 133, it is assumed that the door of the locker is open. Accordingly, a cycle pulse 151 already starts after 0.5 ms.

It is clearly evident for a person skilled in the art that with such a change in the cycle pulses, i.e. the voltage progression on the line 142, more than just the different conditions described can be represented. It is possible, for instance, among other things, to indicated to the network controller 132, by means of a reduction of the cycle pulse to 0.1 ms, that impermissible opening of the locker has occurred. On the other hand, it is also possible, however, that a locker computer 133 or 145 or 146 or 147 only gives off a signal or cycle pulse 148 or 151 which corresponds to an open door, which allows the network controller 132 to check, by means of an internal comparison, whether or not release authorization has been issued, that the locker can be opened. If such a release has not been issued, the network controller 132 is capable of issuing a signal that generates an alarm signal to the system as a whole. In this, it is just possible that triggering of the cycle pulse can be activated not only by the measurement value sensor which indicates the closed or open position of the door, but also by the other measurement value sensors 61, 62 and 80.

Finally, FIG. 28 shows how the data for opening the bank lock can be transmitted from the network controller to the locker computer 133, 145, 146 and 147 in question. This is done by the fact that the supply voltage lying between two cycle pulses 148 to 151 is only 10 volts instead of 15 volts, as is shown in FIG. 28 between the cycle pulse at the time t0 and the cycle pulse 148, or between the cycle pulse 150 and the cycle pulse 151.

FIG. 29 shows the block schematic of a network controller 132. The network controller is connected with an energy source with a voltage of +24 volts, for example, by way of which a microprocessor 152 is possibly also supplied with energy, via corresponding voltage converters or regulators. From the energy source, the line 142 is supplied with a reference voltage of 15 volts via a voltage converter, via a protective resistance 153. To produce the cycle pulses, there is a cycle control element 154, an opener element 155 and a receiver element 156, Which at the same time are also connected with the line 142. Corresponding to the commands of the microprocessor 152, the cycle control element 154, for example a transistor with an open collector output 157 which reduces the voltage on the line 142 to 0, is operated at intervals of 1 ms, for example, but this interval can also be less or greater, and amount to 5 ms, for example. After the pre-determined cycle length, activation of the cycle control element 154 is interrupted, which causes the voltage on the line 142 to go back up to 15 volts. Now if the command or the message that the locker is to be opened is supposed to be transmitted to the locker in question between two cycle pulses, then the voltage on the line 142 can be limited to 10 volts via an opener element 155, which also has an open collector output 157, for example a Zener diode which is set to a threshold value of 10 volts. This makes it possible to achieve the shape of the voltage progression shown in FIG. 28, with the lower voltage on the line making it possible for a locker computer 133 to recognize that a drive 144 is supposed to be opened.

FIG. 30 shows a block schematic of the locker computer 133 which is connected to the line 142. To evaluate the individual data, a microprocessor 159 is also provided. The entire locker computer 133 is supplied with voltage via the line 142, with a screen element 160 and a voltage regulator 161 being provided for this purpose. Furthermore, the microprocessor 159 is connected with the line 142 via two threshold switches 162, 163. Here again, these can also be comparator elements, with a reference voltage applied to each of them via an input 164. Depending on the voltage applied to the line 142, a signal is now issued to the microprocessor 159 via the threshold switch 162, or the threshold switch 163. Since the reference value is set to greater than 10 volts at the threshold switch 162 and to greater than 5 volts at the threshold switch 163, three different voltage conditions on the line 142 can be recognized by the microprocessor 159, namely threshold switches 162 and 163, 15 volts, at least the output of the threshold switch 162 has voltage applied to it and possibly also the output of the threshold switch 163, and 10 volts, only the output of the threshold switch 163 has a signal applied to it.

According to the input conditions defined using FIG. 26 to 28, activation of the line leading from the threshold switch 163 with a signal now means that voltage is to be applied to the drive 144, if necessary via an amplifier 143. By retraction of the bolt with the drive 144, the measurement value sensor 60 is activated and transmits the message "bank lock or bolt open" to the microprocessor 159. Accordingly, the reference voltage of 15 volts with the cycle pulse 148 or 151 is prematurely reduced to 0 during the same inquiry cycle, or, in case of a longer response time of the drive 144, during the next inquiry cycle. This again takes place via an open collector output 157 and a capacitor 165 arranged between the latter and the line 142. In addition, after opening of the door of the locker it can be determined, using the measurement value sensor 80, that the door has been opened, whereupon the voltage drop on the line 142 to 0 volts in accordance with the cycle pulse 149, in other words without any change as compared with the normal cycle pulse, takes place.

With a unit that is structured in such a relatively simple manner, it is therefore possible to supply a plurality of locker computers with energy and data, without a great expenditure in circuitry, especially with a low expenditure for lines. With the additional use of the capacity 165 between the microprocessor 159 and the line 142, it is ensured that even in case of failure of the locker computer 133, the other locker computers 145, 146 and 47 are not blocked and operation of the unit can be maintained.

FIG. 31 shows another block schematic of a locker computer 146. For transmission of data from the line 142 to the locker computer 6, inductive loops 166, 167 are assigned to each other, as was already shown, for example, using the embodiment in FIG. 9 to 11. From the inductive loop 167, lines 69 lead to the locker computer 146. For energy supply to the microprocessor 159, a screen element 160, for example a rectifier, is provided, which is followed by a voltage regulator 161. Parallel to a connection line between the voltage regulator 161 and the microprocessor 159, an energy storage 168 can be provided. This is preferably formed by a battery. The microprocessor has a cycle control element 169, with which the internal calculation processes are controlled. To supply the microprocessor 159 with data, the lines 69 are connected with a receiver 170 and a translation component 171, which in turn is connected in a circuit with the microprocessor 159. An output of the microprocessor 159 is connected with a translation component 172 and a transmitter 173.

Furthermore, as is shown schematically, a coding unit 174 can be connected with the microprocessor 159; this unit makes it possible to input or program the locker number.

Furthermore, the microprocessor 159 is connected with a measurement value sensor 61, for example a capacitive sensor, which is connected with the microprocessor 159 via an evaluation element 175 and an oscillator 176. In addition, it is also possible to connect a ring line 177 to the microprocessor 159 as protection against vandalism. Via the measurement value sensors 60 and 80 it can then be determined whether the bolt is open or closed, and whether the door of the locker 2 is closed or open.

Via a switch element 178, e.g. an open collector output, a drive 144 or 78 can be activated to activate a shutter 74 with a recess 77, so that a keyhole 21 is released or locked for operation with a key.

FIG. 32 shows a lock 16 attached to the door 18 of a locker 2, as well as an auxiliary lock 17. Attachment of the door 18 takes place, as was already explained on the basis of the previous figures, at an armored wall 19, for example. The lock 16 has a locking bolt 24, with which the door 18 can be locked relative to the armored wall 19. The auxiliary lock 17 which was originally provided, and which acts as a bank lock in mechanical double-lock systems, has a locking bolt 179, which is now used, in the present case, to hold an auxiliary lock 26 in place in its position on the door 18. By turning a key 22 of the auxiliary lock 17, the locking bolt 179 can be retracted and with this, a holder stirrup 180, to which the auxiliary lock 26 is rigidly connected, can be released. This makes it possible, for example in the case of a defect, to replace the auxiliary lock 26 without the need for having the locker proprietor be present. To affix the auxiliary lock 26, a guide tab 181 is used.

The auxiliary lock 26, which now allows release of the locker 2 by remote control, comprises a locking pin 27, which is pressed away from the locking bolt 24 by a spring 182. If the locker customer has used the locker 2, he presses the locking pin 27 into the position shown with solid lines, against the effect of the spring 182, in which it is held in place, by a locking tab 183 which also has force applied to it, in such a way that the end facing towards the locking bolt 24 engages with this and makes an adjustment movement of it impossible. If the locker customer then wants to use his locker again, the locking pin is retracted into the position shown with broken lines, by retraction of the locking tab 183, for example via a drive 184 formed by an electromagnet, whereupon the locking tab 183 also goes into the position shown with broken lines, and the locking bolt 24 can be moved with the lock 16. With this structure, the bank lock, which is no longer necessary due to the remote control, can also be used as an emergency activation for the remote-controlled bank lock, in the case of refitting of lockers which are equipped with two mechanical locks.

We claim:

1. A locker unit comprising a plurality of lockers each of which is provided with its own door, each door having a locking device including a mechanical lock and an auxiliary lock attached to the door adjacent to a keyhole in the mechanical lock by attachment means, the auxiliary lock having a rest position blocking access to the mechanical lock and an open position freeing the access, and the auxiliary lock comprising a rotating bolt, a locking plate defining an opening receiving the rotating bolt, an actuating button on the rotating bolt and projecting from the auxiliary lock, locking projections on the rotating bolt and projecting beyond the opening in the locking plate, the locking projections having an open position in alignment with the opening and a closed position in which the locking projections are turned relative to the opening, and a stop device for the rotating bolt, the stop device comprising a spring means biased in the direction of the closed position, a locking element, a bolt cooperating with the locking element, and an electrical drive for actuating the bolt.

2. A locker unit according to claim 1, wherein the attachment means are formed by a self-adhesive glue layer arranged on the auxiliary lock.

3. A locker unit according to claim 1, wherein the attachment means are formed by a holder element which acts together with the mechanical lock in the door.

4. A locker unit according to claim 1, wherein the mechanical lock comprises a locking bolt and the locking device comprises an adjustable locking pin extending perpendicularly to the door, a spring device biasing the locking pin against the locking bolt into a rest position in which the locking pin engages the locking bolt, a locking element holding the locking pin in the rest position, and an electrical drive connected to the locking pin, the electrical drive being arranged perpendicularly adjustable with respect to the locking pin.

5. A locker unit according to claim 1, wherein the mechanical lock comprises a locking bolt and the locking device comprises an adjustable locking pin extending perpendicularly to the door, a spring device biasing the locking pin against the locking bolt into a rest position in which the locking pin engages the locking bolt, and a drive connected to the locking pin for adjusting the locking pin against the bias of the spring device.

6. A locker unit according to claim 1, wherein an opening of the locking device which penetrates the auxiliary lock perpendicular to a door surface is arranged to be aligned to cover the keyhole of the mechanical lock.

7. A locker unit according to claim 6, wherein the auxiliary lock comprises at least one shutter adjustable relative to the keyhole into a rest position and a drive connected to the shutter.

8. A locker unit according to claim 7, further comprising a measurement value sensor associated with the shutter in the test position and actuated when the shutter is moved out of the rest position.

9. A locker unit according to claim 1, further comprising a drive associated with a plurality of said auxiliary locks of a like plurality of said doors, and an actuating device for the drive, the actuating device being adjustable relative to the auxiliary locks and doors.

10. A locker unit according to claim 9, wherein the drive is connected to move with a key for each one of the auxiliary locks, the key having a rest position within the actuating device and a locking position outside the actuating device.

11. A locker unit according to claim 1 wherein measurement value transmitters connected with a control device are assigned to the shutter and/or the auxiliary lock.

12. A locker unit according to claim 11 wherein the measurement value sensor assigned to the auxiliary lock is activated at a distance from the door of the locker.

13. A locker unit according to claim 11 wherein the control device is a locker computer connected by translation components with a communications system for signal transmission between the locker computer and central control unit.

14. A locker unit according to claim 13, wherein the communications system is formed by an armored wall of the locker unit and a line insulated from the armored wall and connected to the control unit.

15. A locker unit according to claim 14 wherein the line is formed by a track arranged on the doors of the lockers, with an insulating layer arranged therebetween.

16. A locker unit according to 15 wherein the track consists of an electrically conductive, especially semiconductive, plastic.

17. A locker unit according to claim 15 wherein the connection of the track between the doors takes place by means of contact devices.

18. A locker unit according to claim 14, wherein the line is formed by a photoconductor, and transmission elements for wireless connection of the photoconductors are arranged between the doors and the armored wall.

19. A locker unit according to claim 18 wherein the transmission elements are provided with a swivelling lens.

20. A locker unit according to claim 15 wherein two tracks are provided and that a track arranged on the door is switched with the one track when the door is closed and with the other track when the door is open.

21. A locker unit according to claim 13, wherein communications system is wireless.

22. A locker unit according to claim 13, wherein the communications system comprises a signal receiver connected to the control device and a signal transmitter connected to the central control unit and located at a distance from the signal receiver.

23. A locker unit according to claim 13, wherein the communications system comprises a light transmitter and a light receiver, especially for infrared light.

24. A locker unit according to claim 23 wherein the translation component of the communications system has translation elements for superimposition of data on the signal, and for screening of information from the signal, between the central control unit and the auxiliary lock.

25. A locker unit according to claim 1, wherein the auxiliary lock covers a keyhole for the mechanical lock arranged in the door.

26. A locker unit according to claim 1, wherein the auxiliary lock or a group of auxiliary locks is connected with an input device.

27. A locker unit according to claim 1, wherein the auxiliary lock or a group of auxiliary locks is connected with a read device.

28. A locker unit according to claim 23, wherein the lines of the communications systems are arranged in a housing of the auxiliary lock.

29. A locker unit according to claim 1, wherein the housings of the auxiliary locks of adjacent doors are connected with one another by contact devices.

30. A locker unit comprising a plurality of lockers each of which is provided with its own door, each door having a locking device including a mechanical lock and an auxiliary lock attached to the exterior of the door facing away from the interior of the locker adjacent to a keyhole in the mechanical lock by attachment means, the auxiliary lock having a rest position preventing opening of the mechanical lock and an open position allowing opening of the mechanical lock, the mechanical lock having a locking bolt, the auxiliary lock having a locking pin movable in a direction perpendicular to the exterior surface of the door and spring means biasing the locking pin the rest position engaging the locking bolt and holding it closed, the auxiliary lock further including an electric drive coupled to the locking pin for disengaging the locking pin from the locking bolt, the auxiliary locks of the individual lockers being connected by a central control unit.

* * * * *